US011545803B1

(12) United States Patent
Wiltraut et al.

(10) Patent No.: US 11,545,803 B1
(45) Date of Patent: Jan. 3, 2023

(54) CONNECTOR LOADING ASSEMBLY FOR ELECTRICAL CONNECTOR ASSEMBLING MACHINE

(71) Applicant: TE Connectivity Services GmbH, Schaffhausen (CH)

(72) Inventors: David Wiltraut, Middletown, PA (US); Craig Roper, Middletown, PA (US); Jeffrey Zerbe, Bressler, PA (US); Scott A. Day, Jacobus, PA (US); Edward T. Price, III, Mechanicsburg, PA (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/388,729

(22) Filed: Jul. 29, 2021

(51) Int. Cl.
*H01R 43/16* (2006.01)

(52) U.S. Cl.
CPC ..... *H01R 43/16* (2013.01)

(58) Field of Classification Search
CPC ..... H01R 43/16; H01R 43/18; H01R 43/24; H01R 12/716; Y10T 29/49174; Y10T 29/49176; Y10T 29/49204; Y10T 29/53209; Y10T 29/53243
USPC ..... 29/857, 858, 874, 747, 755
See application file for complete search history.

(56) References Cited

U.S. PATENT DOCUMENTS 5,148,596 A * 9/1992 Zahn ..... H01R 43/24 29/564.6
5,957,725 A * 9/1999 Bianca ..... H01R 12/716 439/937
6,202,853 B1 * 3/2001 Bianca ..... H05K 13/0084 264/272.14
6,237,220 B1 * 5/2001 Apel ..... H01R 43/18 29/874

* cited by examiner

*Primary Examiner* — Donghai D Nguyen

(57) ABSTRACT

An electrical connector assembling machine includes a connector strip distribution unit including a reel cradle for holding a reel of the connector strip and a roller for rotating the reel of the connector strip to unwind the connector strip from the reel. The electrical connector assembling machine includes a connector strip feed unit including a feeding device configured to index the connector strip through a feed track in successive feed strokes. The electrical connector assembling machine includes a connector strip notching unit including a notching device configured to cut notches in the connector strip at designated locations. The electrical connector assembling machine includes a contact loading unit loading contacts into the connector strip and an electrical connector separating unit for separating the electrical connector from the connector strip.

28 Claims, 15 Drawing Sheets

CONNECTOR LOADING ASSEMBLY FOR ELECTRICAL CONNECTOR ASSEMBLING MACHINE

BACKGROUND OF THE INVENTION

The subject matter herein relates generally to machines for manufacturing electrical connectors.

Machines are known for assembling electrical connectors. For example, some known machines are used to load contacts into a connector housing. Manufacture and assembly of individual connectors is time consuming and expensive. For example, individually loading the contacts into the connector housing is time consuming. Conventional machines are typically designed to manufacture one particular electrical connector arrangement. Changeover of the machine to manufacture a different type of electrical connector is time consuming and involves replacement of many components of the machine.

A need remains for a machine for efficiently and reliably manufacturing electrical connectors.

BRIEF DESCRIPTION OF THE INVENTION

An electrical connector assembling machine for assembling an electrical connector includes a connector housing manufactured from a connector strip that is a continuous extruded dielectric material and contacts manufactured from continuous contact strips is provided. The electrical connector assembling machine includes a connector strip distribution unit including a reel cradle for holding a reel of the connector strip. The connector strip distribution unit includes a roller for rotating the reel of the connector strip to unwind the connector strip from the reel. The connector strip distribution unit includes a roller actuator operably coupled to the roller to rotate the roller. The electrical connector assembling machine includes a connector strip feed unit including a feed track receiving the connector strip. The connector strip feed unit includes a feeding device configured to index the connector strip through the feed track in successive feed strokes. The feeding device includes a holding device having a holding clamp and an indexing device having an indexing clamp. The holding clamp is in a fixed position. The feeding device includes an indexer operably coupled to the indexing device. The indexer moves the indexing device relative to the holding device from a retracted position to an advanced position. The indexing device moves the connector strip as the indexing device is moved from the retracted position to the advanced position. The indexing device moves relative to the connector strip as the indexing device is returned from the advanced position to the retracted position. The electrical connector assembling machine includes a connector strip notching unit including a notching device configured to cut notches in the connector strip at designated locations defining ends of connector housings formed from the connector strip. The notching device includes a plurality of cutters for selectively cutting through the dielectric material of the connector strip. The connector strip notching unit includes a notching unit controller operably coupled to the plurality of cutters to selectively operate the cutters as the connector strip is indexed through the feed track in the successive feed strokes. The electrical connector assembling machine includes a contact loading unit including a contact loading device loading contacts into the connector strip as the connector strip is advanced through the electrical connector assembling machine. The electrical connector assembling machine includes an electrical connector separating unit includes a cutting device for separating the electrical connector from the connector strip.

In another embodiment, an electrical connector assembling machine for assembling an electrical connector includes a connector housing manufactured from a connector strip that is a continuous extruded dielectric material and contacts manufactured from continuous contact strips is provided. The electrical connector assembling machine includes a connector strip distribution unit includes a reel cradle for holding a reel of the connector strip. The electrical connector assembling machine includes a connector strip feed unit includes a feed track receiving the connector strip. The connector strip feed unit includes a feeding device configured to index the connector strip through the feed track in successive feed strokes. The feeding device includes a holding device having a holding clamp and an indexing device having an indexing clamp. The holding clamp is in a fixed position. The feeding device includes an indexer operably coupled to the indexing device. The indexer moves the indexing device relative to the holding device from a retracted position to an advanced position. The indexing device moves the connector strip as the indexing device is moved from the retracted position to the advanced position. The indexing device moves relative to the connector strip as the indexing device is returned from the advanced position to the retracted position. The electrical connector assembling machine includes a connector strip notching unit includes a notching device configured to cut notches in the connector strip at designated locations defining ends of connector housings formed from the connector strip. The electrical connector assembling machine includes a contact loading unit includes a contact loading device loading contacts into the connector strip as the connector strip is advanced through the electrical connector assembling machine. The electrical connector assembling machine includes an electrical connector separating unit including a cutting device for separating the electrical connector from the connector strip.

In a further embodiment, an electrical connector assembling machine for assembling an electrical connector includes a connector housing manufactured from a connector strip that is a continuous extruded dielectric material and contacts manufactured from continuous contact strips is provided. The electrical connector assembling machine includes a connector strip distribution unit including a reel cradle for holding a reel of the connector strip. The electrical connector assembling machine includes a connector strip feed unit includes a feed track receiving the connector strip. The connector strip feed unit includes a feeding device configured to index the connector strip through the feed track in successive feed strokes. The electrical connector assembling machine includes a connector strip notching unit includes a notching device configured to cut notches in the connector strip at designated locations defining ends of connector housings formed from the connector strip. The notching device includes a plurality of cutters for selectively cutting through the dielectric material of the connector strip. The connector strip notching unit includes a notching unit controller operably coupled to the plurality of cutters to selectively operate the cutters as the connector strip is indexed through the feed track in the successive feed strokes. The electrical connector assembling machine includes a contact loading unit includes a contact loading device loading contacts into the connector strip as the connector strip is advanced through the electrical connector assembling machine. The electrical connector assembling machine includes an electrical connector separating unit includes a cutting device for separating the electrical connector from the connector strip.

In a further embodiment, an electrical connector assembling machine for assembling an electrical connector includes a connector housing manufactured from a connector strip that is a continuous extruded dielectric material and contacts manufactured from continuous contact strips is provided. The electrical connector assembling machine includes a connector strip distribution unit including a reel cradle for holding a reel of the connector strip. The connector strip distribution unit includes a roller for rotating the reel of the connector strip to unwind the connector strip from the reel. The connector strip distribution unit includes a roller actuator operably coupled to the roller to rotate the roller. The electrical connector assembling machine includes a connector strip feed unit includes a feed track receiving the connector strip. The connector strip feed unit includes a feeding device configured to index the connector strip through the feed track in successive feed strokes. The electrical connector assembling machine includes a connector strip notching unit includes a notching device configured to cut notches in the connector strip at designated locations defining ends of connector housings formed from the connector strip. The electrical connector assembling machine includes a contact loading unit includes a contact loading device loading contacts into the connector strip as the connector strip is advanced through the electrical connector assembling machine. The electrical connector assembling machine includes an electrical connector separating unit includes a cutting device for separating the electrical connector from the connector strip.

DETAILED DESCRIPTION OF THE INVENTION

Figure 1:
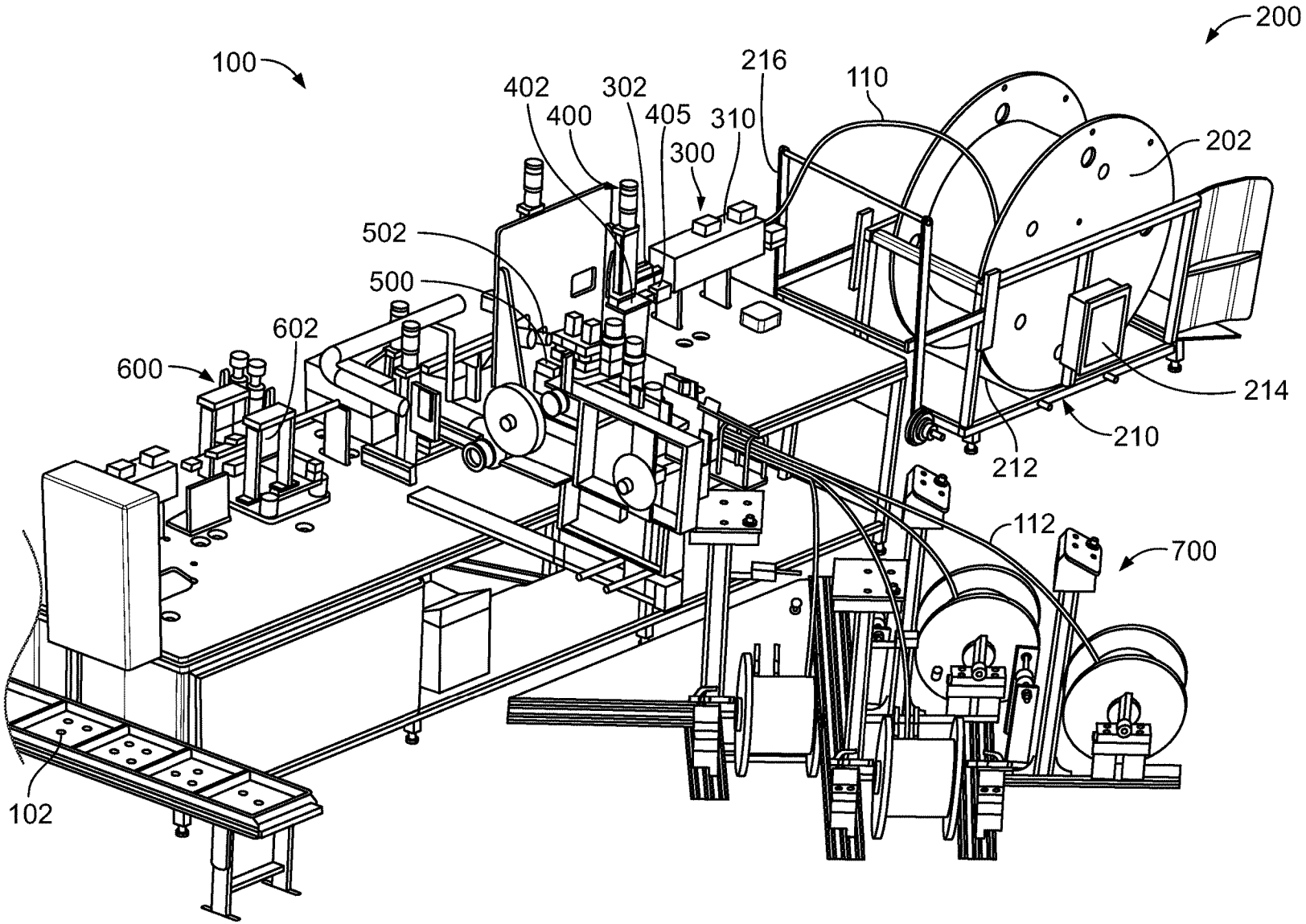
FIG. 1 illustrates an electrical connector assembling machine in accordance with an exemplary embodiment.

FIG. 1 illustrates an electrical connector assembling machine 100 in accordance with an exemplary embodiment. The electrical connector assembling machine 100 is used for assembling electrical connectors 102 (shown in further detail in FIGS. 2 and 5-10). For example, the electrical connector assembling machine 100 is used for forming connector housings 104 from a connector strip 110, which is a continuous extruded dielectric material connector strip. The electrical connector assembling machine 100 is used for forming contacts 106 manufactured from continuous contact strips 112. The electrical connector assembling machine 100 manufactures the electrical connectors 102 in a continuous, feed based manufacturing process, wherein formed electrical connectors 102 are separated from the continuous strip. The electrical connectors 102 may have various lengths to vary the number of positions or contacts within the electrical connector 102 for a particular application (for example, between 2 positions and 30 positions).

In an exemplary embodiment, the electrical connector assembling machine 100 is used for assembling mass termination assembly (MTA) electrical connectors, such as MTA 100 or MTA 156 connectors commercially available from TE Connectivity. For example, the electrical connector assembling machine 100 is used for assembling board mounted header connectors. The MTA 100 connectors have contacts in a single row on 0.100" (2.54 mm) centerline spacing between 2 and 28 positions. The MTA 156 connectors have contacts in a single row on 0.156" (3.96 mm) centerline spacing between 2 and 24 positions. The header connectors may be right angle connectors or vertical mount connectors. The header connectors may have latching features for latched coupling with the mating, receptacle connectors. The header connectors may have polarizing features, such as notches, for keyed mating with the receptacle connectors. The header connectors may have different colors (for example, MTA 100 vs MTA 156). The header connectors may have the contacts with different plating to offer solutions for a multitude of diverse applications.

The electrical connector assembling machine 100 includes a connector loading assembly 150 for supplying the connector housings 104 and a contact loading assembly 152 for supplying the contacts 106. The connector loading assembly 150 and the contact loading assembly 152 operate synchronously to manufacture the electrical connectors 102. The connector loading assembly 150 of the electrical connector assembling machine 100 includes a connector strip distribution unit 200, a connector strip feed unit 300 and a connector strip notching unit 400. The contact loading assembly 152 of the electrical connector assembling machine 100 includes a contact loading unit 500. The electrical connector assembling machine 100 may further include an electrical connector separating unit 600. The connector strip distribution unit 200 is used to distribute the connector strip 110 to the machine 100. The connector strip feed unit 300 is used to feed the connector strip 110 through the machine 100. The connector strip notching unit 400 is used to process the connector strip 110 during a manufacturing process. The contact loading unit 500 is used to feed the contact strip 112 through the machine 100. The electrical connector separating unit 600 is used to separate the assembled electrical connectors 102 from the strip. The electrical connector assembling machine 100 may include additional units in alternative embodiments for performing additional manufacturing processes.

The connector strip distribution unit 200 includes a reel cradle 210 for holding a reel 202 of the connector strip 110. The connector strip distribution unit 200 is used to unwind the connector strip 110 from the reel 202. In an exemplary embodiment, the connector strip distribution unit 200 includes a roller 212 for rotating the reel 202 of the connector strip 110 to unwind the connector strip 110 from the reel 202. The roller 212 automatically unwinds the connector strip 110 from the reel 202, such as to provide a slack length of the connector strip 110, which may be easily feed through the machine 100 without pulling the connector strip 110 tight at the reel 202. The roller 212 unwinds the connector strip 110 independent of the connector strip feed unit 300. For example, the connector strip feed unit 300 does not need to pull the connector strip 110 off of the reel 202. Rather, the connector strip 110 may be fed from the slack length that is unwound from the reel 202 by the roller 212.

In an exemplary embodiment, the connector strip distribution unit 200 includes a roller actuator 214 operably coupled to the roller 212 to rotate the roller 212. The roller actuator 214 may be a motor or other device used to rotate the roller 212, which in turn rotates the reel 202 to unwind the connector strip 110 from the reel 202. In an exemplary embodiment, the connector strip distribution unit 200 includes a roller trigger 216 operably coupled to the roller actuator 214 to activate the roller actuator 214 and cause the roller actuator 214 to rotate the roller 212.

In an exemplary embodiment, the connector strip feed unit 300 includes a feed track 302 receiving and guiding the connector strip 110 through the machine 100. The connector strip feed unit 300 includes a feeding device 310 configured to index the connector strip 110 through the feed track 302 in successive feed strokes. For example, the feeding device 310 may feed a defined length of the connector strip 110 for each feed stroke. In an exemplary embodiment, the feeding device 310 feeds the same length of connector strip 110 for each feed stroke. In various embodiments, the feeding device 310 may feed a length of the connector strip 110 corresponding to four contact positions or a four position connector length. For example, the feeding device 310 may feed 0.400" (10.16 mm) (for example, when manufacturing MTA 100 connectors) or 0.624" (15.84 mm) (for example, when manufacturing MTA 156 connectors).

In an exemplary embodiment, the connector strip notching unit 400 including a notching device 402 configured to cut notches in the connector strip 110 at designated locations. For example, the notches may be provided at ends of the connector housings 104 formed from the connector strip 110. The locations of the notches may be varied depending on the length of the connector housings 104 (for example, based on the number of contact positions of the electrical connector 102 being manufactured). In an exemplary embodiment, the notching device 402 includes a plurality of cutters 404 (shown in FIG. 21) for selectively cutting through the dielectric material of the connector strip 110. The connector strip notching unit 400 includes a notching unit controller 406 operably coupled to the plurality of cutters 404 to selectively operate or actuate the cutters 404 as the connector strip 110 is indexed through the machine 100.

In an exemplary embodiment, the contact loading unit 500 includes a contact loading device 502 loading the contacts 106 into the connector strip 110 as the connector strip 110 is advanced through the electrical connector assembling machine 100. The contact loading device 502 may be used to simultaneously load multiple contacts 106 into the connector strip 110. For example, the connector strip 110 may remain at a fixed location for a period of time, during which the multiple contacts 106 are loaded into the connector strip 110, and then the connector strip 110 may be advanced during a feed stroke where another set of the contacts 106 may again be loaded into the connector strip 110. In various embodiments, four contacts 106 may be loaded into corresponding positions in the connector strip 110 during each feed stroke.

In an exemplary embodiment, the electrical connector separating unit 600 is located downstream of the contact loading unit 500. The electrical connector separating unit 600 includes a cutter 602 for separating the electrical connectors 102, with the contacts 106 in the connector housing 104, from the connector strip 110 as the connector strip 110 is advanced through the electrical connector assembling machine 100. After the contacts 106 are loaded into the connector strip 110, the loaded connector housings 104 are separated from the connector strip 110 to form the electrical connector 102. The length of the connector housings 104 may be varied to vary the number of contacts 106 included in the electrical connector 102. For example, the machine 100 may manufacture short electrical connectors (for example, 2 or 4 position connectors), medium electrical connectors (for example, 10 or 15 position electrical connectors) or long electrical connectors (for example, 20 or 28 position electrical connectors). The machine may be used to make any reasonable length electrical connectors (for example, greater than 28 positions). The electrical connector separating unit 600 includes a cutting device 602 for separating the electrical connectors 102 from the connector strip 110.

Figure 2:
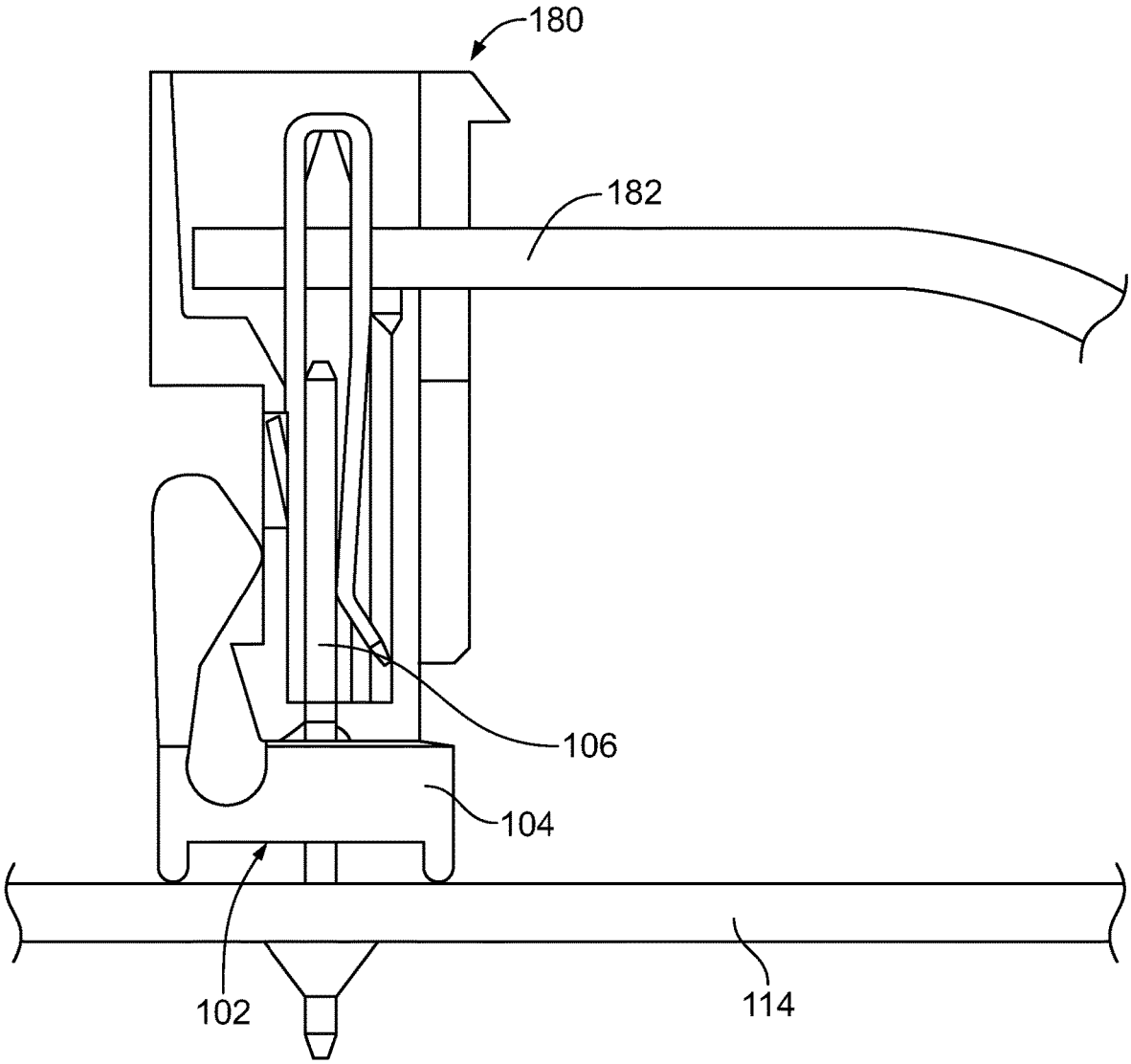
FIG. 2 is a cross sectional view of the electrical connector manufactured by the electrical connector assembling machine (FIG. 1) in accordance with an exemplary embodiment.

FIG. 2 is a cross sectional view of the electrical connector 102 manufactured by the electrical connector assembling machine 100 (FIG. 1) in accordance with an exemplary embodiment. The electrical connector 102 includes the connector housing 104 and the contact(s) 106 received in the connector housing 104. Any number of the contacts 106 may be received in the connector housing 104 (for example, between 2 and 28 contacts). The electrical connector 102 is a header connector mounted to a printed circuit board 114. The contacts 106 may be soldered to the printed circuit board 114.

A receptacle connector 180 is shown coupled to the electrical connector 102. The receptacle connector 180 is shown terminated to an end of a wire 182; however, the receptacle connector 180 may be coupled to a circuit board in alternative embodiments. The electrical connector 102 is a vertical connector with the receptacle connector 180 mated in a vertical direction (for example, downward) in a direction perpendicular to the printed circuit board 114. In alternative embodiments, the electrical connector 102 may be a right angle header connector configured to be mated with the receptacle connector in a mating direction parallel to the printed circuit board 114.

Figure 3:
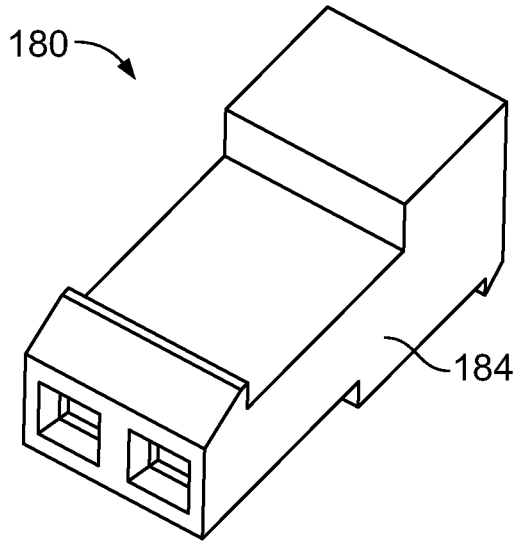
FIG. 3 is a front perspective view of the receptacle connector in accordance with an exemplary embodiment.
Figure 4:
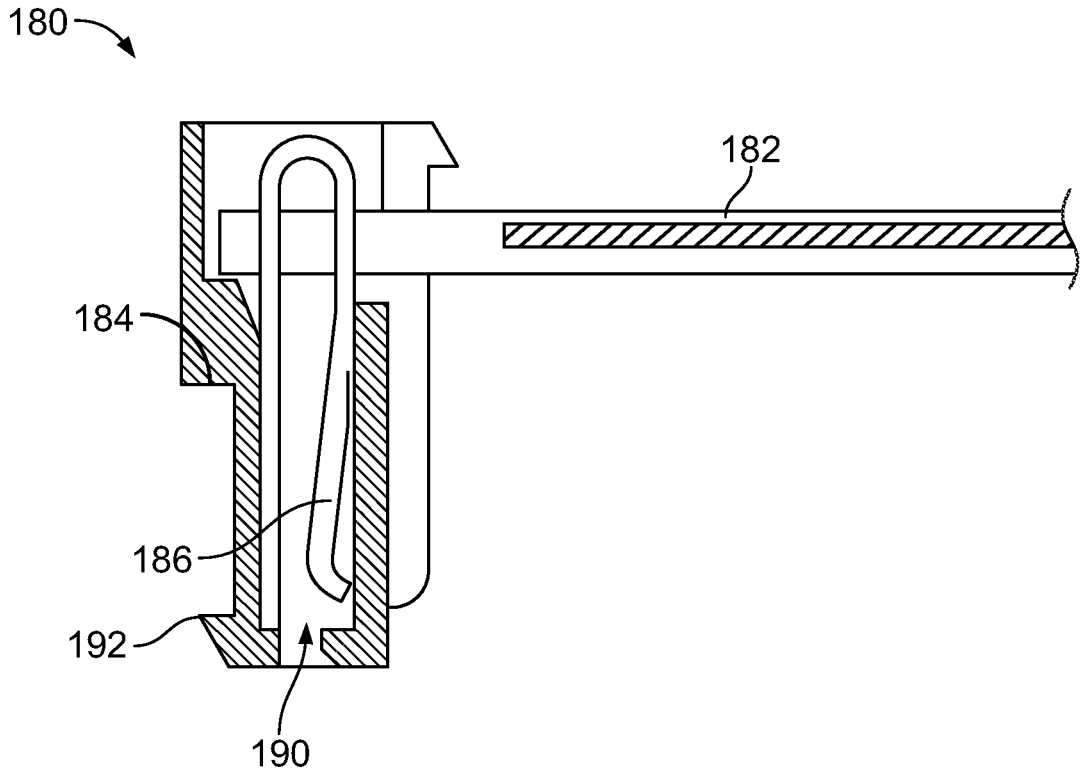
FIG. 4 is a cross-sectional view of the receptacle connector in accordance with an exemplary embodiment.

With additional reference to FIGS. 3 and 4, FIG. 3 is a front perspective view of the receptacle connector 180 and FIG. 4 is a cross-sectional view of the receptacle connector 180 in accordance with an exemplary embodiment. The receptacle connector 180 includes a connector housing 184 holding a contact 186. The contact 186 is terminated to an end of the wire 182. In the illustrated embodiment, the contact 186 is a socket contact. The connector housing 184 includes receptacles 190 that receive the contacts 186. The receptacles 190 guide mating of the contacts 186 with the contacts 106 (FIG. 2) of the electrical connector 102. The connector housing 184 includes a latching feature 192 for securing the receptacle connector 180 to the electrical connector 102.

Figure 5:
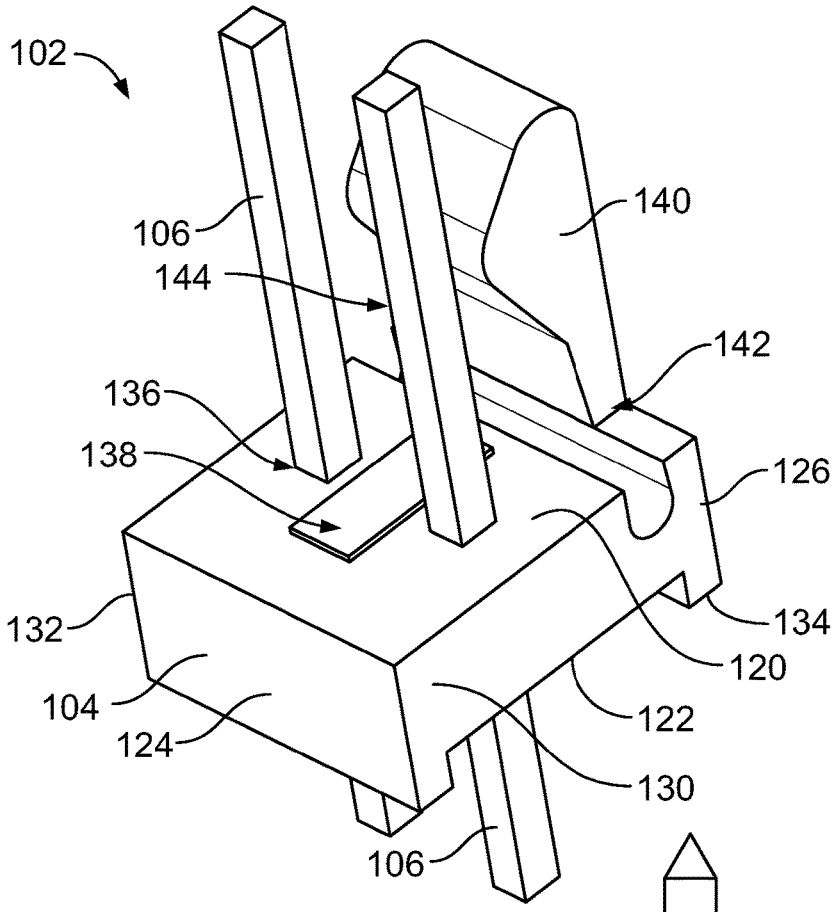
FIG. 5 is a perspective view of the electrical connector in accordance with an exemplary embodiment.
Figure 6:
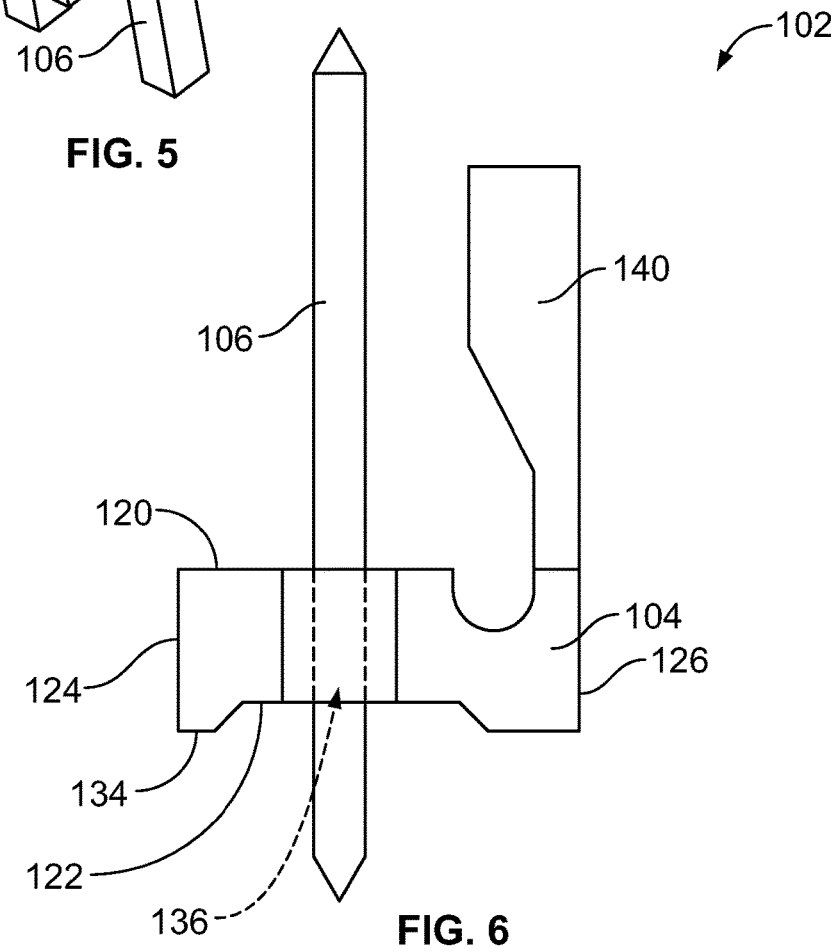
FIG. 6 is a side view of the electrical connector in accordance with an exemplary embodiment.
Figure 7:
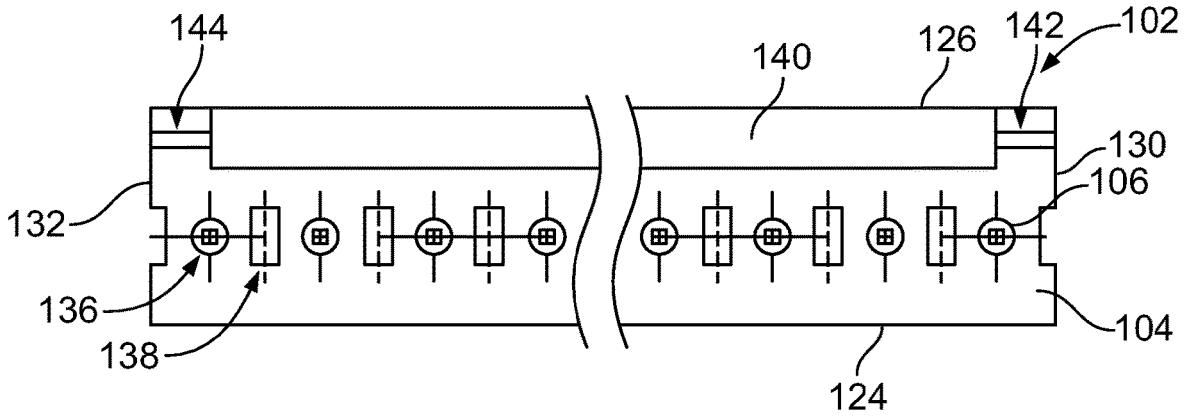
FIG. 7 is a front view of the electrical connector in accordance with an exemplary embodiment.
Figure 8:
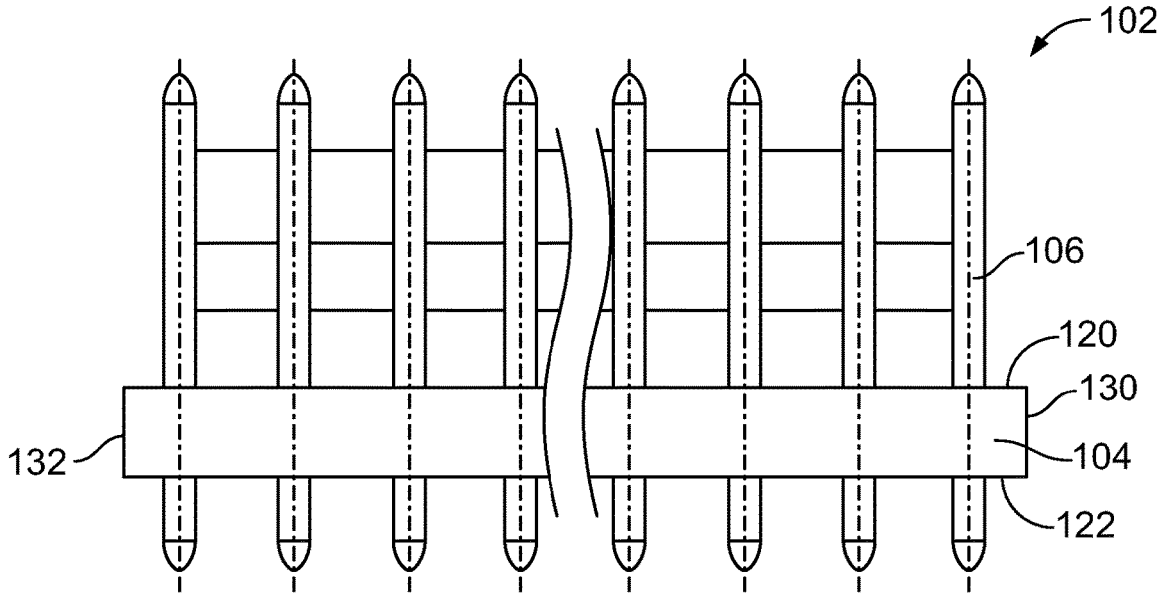
FIG. 8 is an end view of the electrical connector in accordance with an exemplary embodiment.

FIG. 5 is a perspective view of the electrical connector 102 in accordance with an exemplary embodiment. FIG. 6 is a side view of the electrical connector 102 in accordance with an exemplary embodiment. FIG. 7 is a front view of the electrical connector 102 in accordance with an exemplary embodiment. FIG. 8 is an end view of the electrical connector 102 in accordance with an exemplary embodiment. The electrical connector 102 is manufactured by the electrical connector assembling machine 100 (FIG. 1). For example, the electrical connector assembling machine 100 is used to load the contacts 106 into the continuous strip of material defining the connector housing 104. The connector housings 104 with the contacts 106 therein are then separated from the continuous strip to form the electrical connectors 102. The electrical connectors 102 may be made in various lengths to vary the number of contacts 106 in the electrical connector 102 (for example, any length between 2 positions and 28 positions). FIG. 5 shows the electrical connector 102 as a two position electrical connector. FIGS. 7 and 8 illustrate the electrical connector 102 as a multi-position connector, such as greater than an eight position connector.

The connector housing 104 is made from the connector strip 110 (shown in FIG. 1), which is a continuous extruded dielectric material that is formed into a predetermined shape, such as an L-shape. The connector housing 104 includes a front 120 and a rear 122 opposite the front 120. Optionally, the connector housing 104 may be mounted to the printed circuit board 114 (shown in FIG. 2) such that the front 120 is a top of the connector housing 104 and the rear 122 is a bottom of the connector housing 104. Other mounting orientations are possible in alternative embodiments. The connector housing 104 includes a first end 124 and a second end 126 opposite the first end 124. The connector housing 104 includes a first side 130 and a second side 132 opposite the first side 130. The sides 130, 132 are cut sides formed by cutting the connector housing 104 from the connector strip 110.

In an exemplary embodiment, the connector housing 104 includes mounting feet 134 at the rear 122 for mounting the connector housing 104 to the printed circuit board 114. The mounting feet 134 may be provided at the first and second ends 124, 126 in various embodiments.

In an exemplary embodiment, the connector housing 104 includes contact openings 136 therethrough that receive corresponding contacts 106. The contact openings 136 may be preformed (for example, cut or drilled) through the main body of the connector housing 104. Alternatively, the contacts 106 may be pressed through the main body of the connector housing 104 during assembly to form the contact openings 136. Optionally, the main body of the connector housing 104 may be manufactured with windows 138 (FIG. 7) located between the contact openings 136. The windows may reduce the weight of the connector housing 104.

In an exemplary embodiment, the connector housing 104 includes a finger 140 extending from the front 120 of the main body. In the illustrated embodiment, the finger 140 is located at the second end 126. The finger 140 is a friction lock finger in various embodiments used for securing the receptacle connector 180 (shown in FIG. 2) to the electrical connector 102. In alternative embodiments, the connector housing 104 may be manufactured without the finger 140. For example, the connector strip 110 may be extruded without the finger 140.

In an exemplary embodiment, portions of the finger 140 are removed during the manufacturing process, such as by the connector strip notching unit 400 (shown in FIG. 1). For example, notches 142, 144 are formed on the sides of the finger 140. The notches 142, 144 are provided to shape the connector housing 104 for mating with the receptacle connector 180. For example, the notches 142, 144 provide a space to receive the receptacle housing 184 of the receptacle connector 180. The notches 142, 144 are provided at the first and second sides 130, 132 in the illustrated embodiment. Other positions are possible in alternative embodiments. In other various embodiments, a single notch 142 or 144 is provided.

Figure 9:
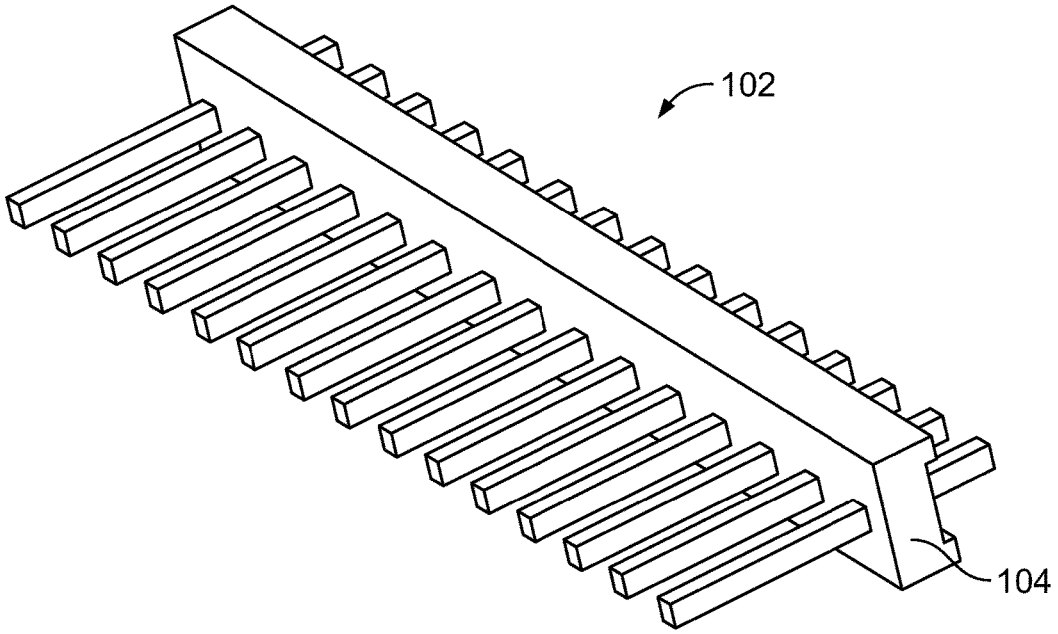
FIG. 9 is a perspective view of the electrical connector in accordance with an exemplary embodiment.

FIG. 9 is a perspective view of the electrical connector 102 in accordance with an exemplary embodiment. In the illustrated embodiment, the connector housing 104 is provided without the finger 140 (shown in FIG. 5). Such embodiment is less expensive to manufacture because the connector housing 104 uses less material.

Figure 10:
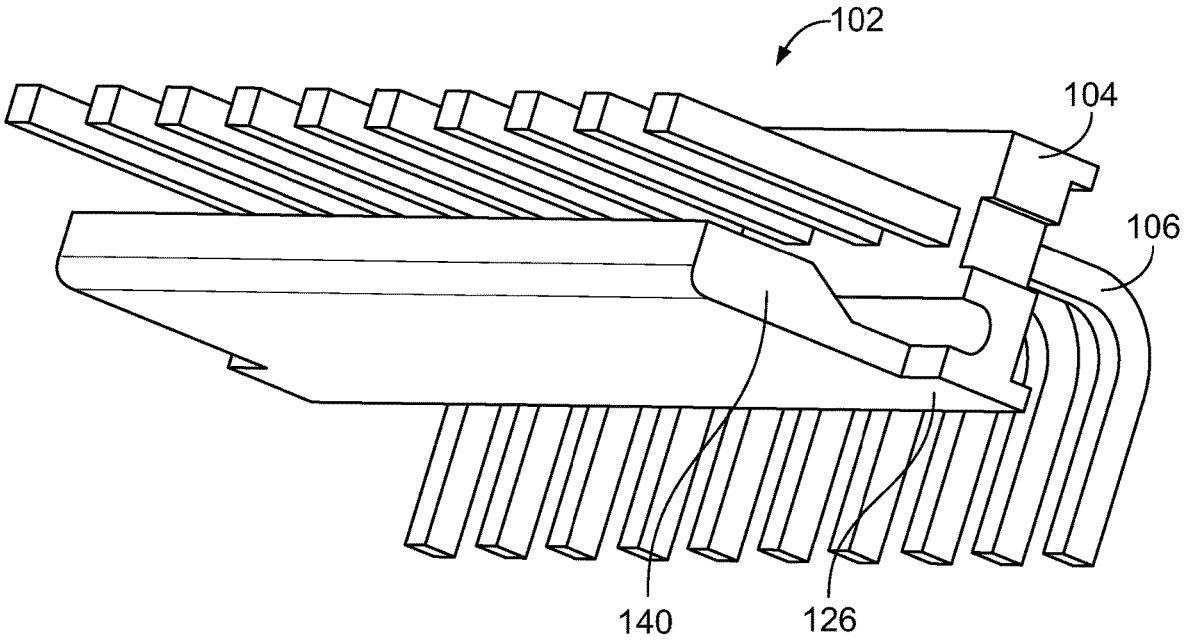
FIG. 10 is a perspective view of the electrical connector in accordance with an exemplary embodiment.

FIG. 10 is a perspective view of the electrical connector 102 in accordance with an exemplary embodiment. In the illustrated embodiment, the electrical connector 102 is a right-angle header connector. The contacts 106 are bent to include a right-angle bend. In such embodiment, the second end 126 is configured to be mounted to the printed circuit board 114 (shown in FIG. 2). In the illustrated embodiment, the connector housing 104 includes the finger 140.

Figure 11:
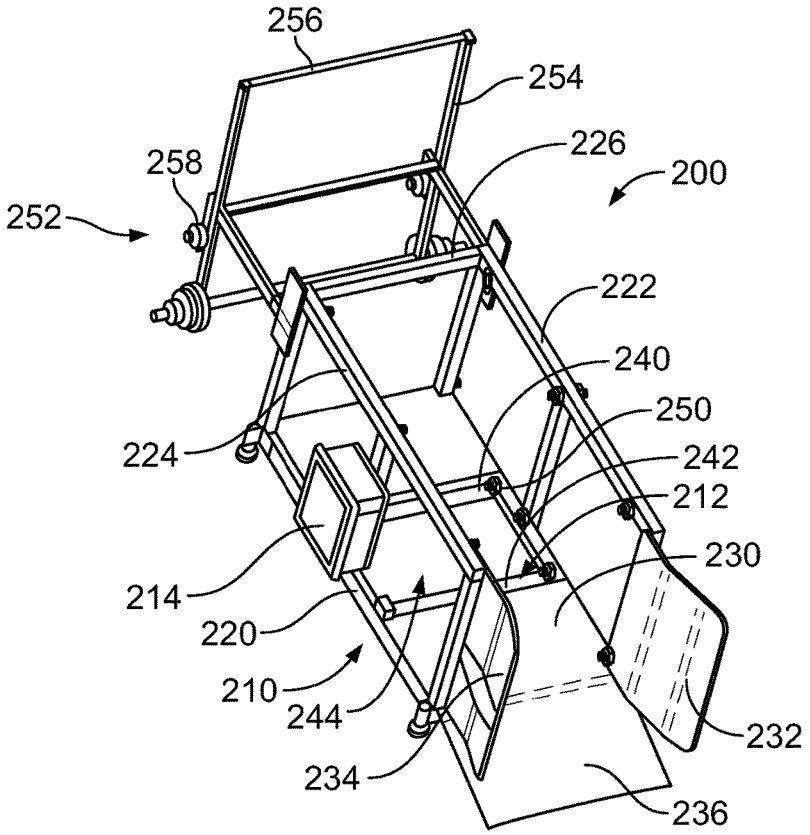
FIG. 11 is a rear perspective view of a portion of the electrical connector assembling machine showing the connector strip distribution unit in accordance with an exemplary embodiment.
Figure 12:
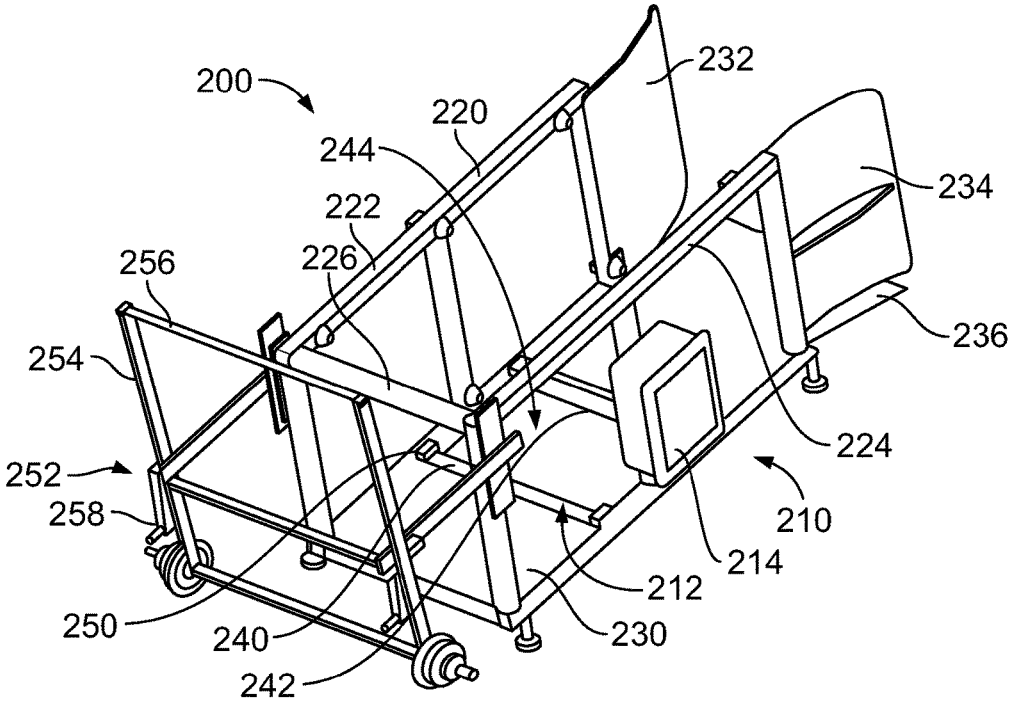
FIG. 12 is a front perspective view of a portion of the electrical connector assembling machine showing the connector strip distribution unit in accordance with an exemplary embodiment.
Figure 13:
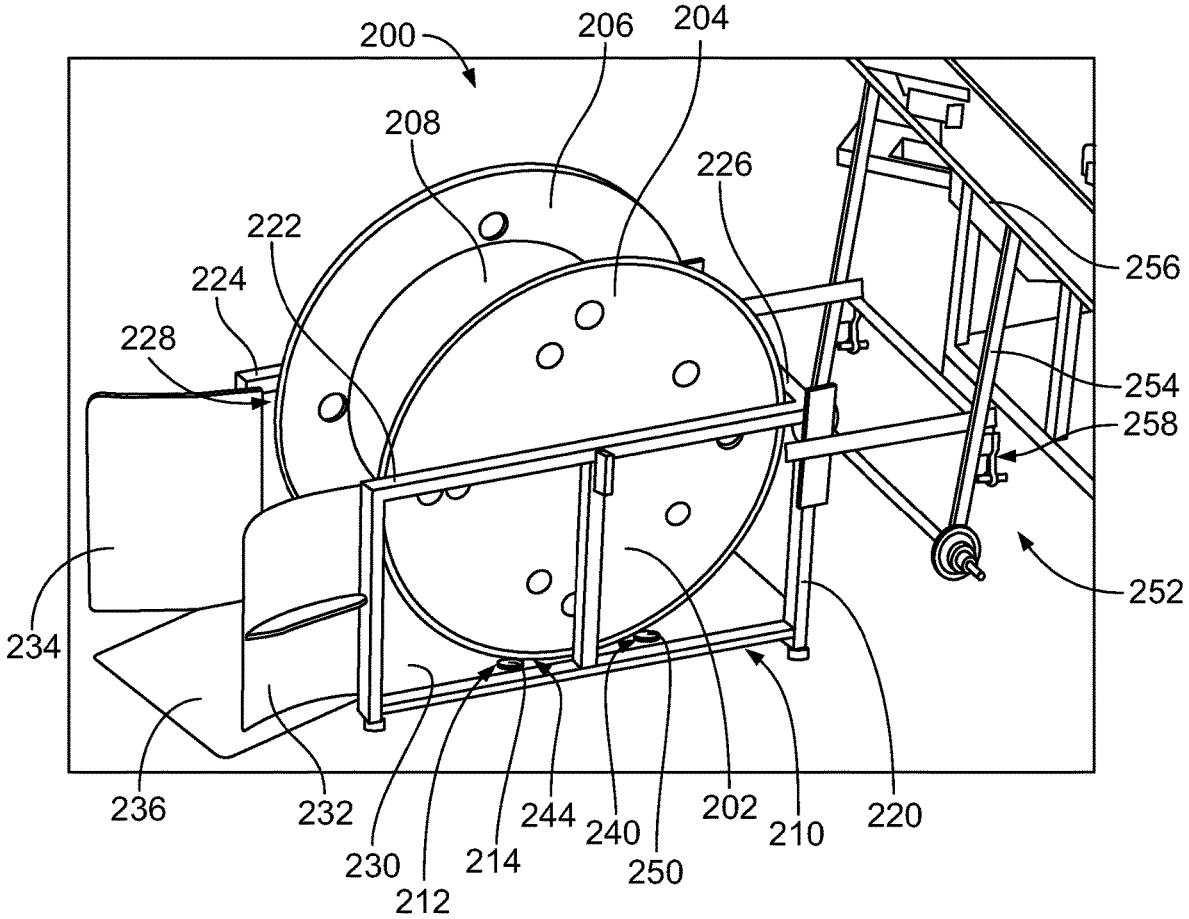
FIG. 13 is a perspective view of the connector strip distribution unit showing the reel loaded into the reel cradle in accordance with an exemplary embodiment.

FIG. 11 is a rear perspective view of a portion of the electrical connector assembling machine 100 showing the connector strip distribution unit 200. FIG. 12 is a front perspective view of a portion of the electrical connector assembling machine 100 showing the connector strip distribution unit 200. FIG. 13 is a perspective view of the connector strip distribution unit 200 showing the reel 202 loaded into the reel cradle 210.

The reel 202 includes flanges 204, 206 at opposite sides of the reel 202 and a barrel 208 between the flanges 204, 206. The connector strip 110 is wound on the barrel 208 between the flanges 204, 206. The flanges 204, 206 are circular to allow rolling of the reel 202 on the roller 212 of the connector strip distribution unit 200. The reel 202 includes a large, continuous supply of the connector strip 110 used for forming the electrical connectors 102. For example, the reel 202 may hold hundreds or even thousands of meters of the connector strip 110. The reel 202 is heavy and is moved using a lift truck or by rolling the reel 202 on the flanges 204, 206.

The reel cradle 210 is sized and shaped to receive the reel 202. The reel cradle 210 includes a frame 220 having side walls 222, 224 and an end wall 226 at a front of the reel cradle 210. The reel cradle 210 is open at the rear to receive the reel 202. The frame 220 forms a chute 228 between the side walls 222, 224 that receives the reel 202. In an exemplary embodiment, the reel cradle 210 includes a platform 230 at a bottom of the frame 220. The platform 230 may be used to support the reel 202, such as during loading and unloading. Optionally, the reel cradle 210 may include guide walls 232, 234 loading into the chute 228 and a ramp 236 loading to the platform 230. During loading, the reel 202 is rolled into the chute 228 up the ramp 236 to the platform 230. The guide walls 232, 234 guide the reel 202 into the chute 228.

The roller 212 is provided at the bottom of the reel cradle 210. For example, the roller 212 may be coupled to the platform 230. The reel 202 is positioned in the reel cradle 210 such that the reel 202 is supported by the roller 212. For example, the reel 202 may be rotated on the roller 212 without moving forward or rearward on the platform 230. In an exemplary embodiment, the roller 212 includes a front roller device 240 and a rear roller device 242. The roller devices 240, 242 are spaced apart from each other. A pocket 244 is defined between the roller devices 240, 242. The pocket 244 receives the reel 202 such that the flanges 204, 206 engage the roller devices 242. The roller devices 240, 242 spin or rotate along parallel axes to rotate the reel 202. The roller devices 240, 242 support the bottom of the reel 202 and unwind the connector strip 110 by rotating the reel 202. Optionally, the roller devices 240, 242 may be rotated in a reverse direction to wind up the connector strip 110 on the reel 202, such as if too much length of the connector strip 110 is unwound. In other various embodiments, a separate drive wheel may be provided, such as under the platform 230 that engages the reel 202 and rotates the reel 202. In such embodiment, the roller devices 240, 242 are free spinning and used only for support rather than for driving unwinding of the reel 202.

In an exemplary embodiment, the roller actuator 214 is operably coupled to the front roller device 240 and/or the rear roller device 242 to rotate the front roller device 240 and/or the rear roller device 242 to rotate the reel 202. The roller actuator 214 includes an electric motor 250 for rotating the front roller device 240 and/or the rear roller device 242. In various embodiments, the electric motor 250 may be operated continuously to feed the connector strip 110 to the electrical connector assembling machine 100. Alternatively, the electric motor 250 may be operated intermittently to feed the connector strip 110 to the electrical connector assembling machine 100. For example, upon a trigger event (for example, demand), the electric motor 250 may be operated to feed a length of the connector strip 110. Optionally, an excess amount of the connector strip 110 may be fed such that a slack length of the connector strip 110 is available for the electrical connector assembling machine 100 to use prior to feeding additionally material. The operation may be controlled by a timer in various embodiments, such as to unwind the material every X seconds. Alternatively, as in the illustrated embodiment, the operation may be controlled by an activation device 252 operably coupled to the electric motor 250.

The activation device 252 is provided at the front of the connector strip distribution unit 200. The activation device 252 is used to operate the electric motor 250 to spin the roller 212. For example, the activation device 252 is used to turn on and/or turn off the electric motor 250. In an exemplary embodiment, the activation device 252 is activated by the connector strip 110. For example, the connector strip 110 may engage the activation device 252 to activate the electric motor 250. In an exemplary embodiment, the activation device 252 includes arms 254 and a support rail 256 between the arms 254. The arms 254 are provided at opposite sides of the reel cradle 210, such as extending forward of the side walls 222, 224. The support rail 256 spans across the front of the reel cradle 210 forward of the reel 202. The support rail 256 may support the connector strip 110 leaving the reel 202. The connector strip 110 passes over the support rail 256 to the electrical connector assembling machine 100 and may be elevated above the support rail 256. For example, the slack length of the connector strip 110 that is unwound may cause the connector strip 110 to lift off of the support rail 256. As the connector strip 110 is fed into the electrical connector assembling machine 100, the connector strip 110 is pulled downward toward the support rail 256. Eventually, the connector strip 110 is fed through the electrical connector assembling machine 100 such that the connector strip pulls downward on the support rail 256 to trigger the activation device 252. For example, the arms 254 may be pivoted to activate the activation device 252. In an exemplary embodiment, the activation device 252 includes an activation switch 258. When the arms 254 are rotated, the activation switch 258 is activated (for example, opened or closed), which causes the roller actuator 214 to turn on and rotate the roller 212 to unwind a length of the connector strip 110 from the reel 202.

Figure 14:
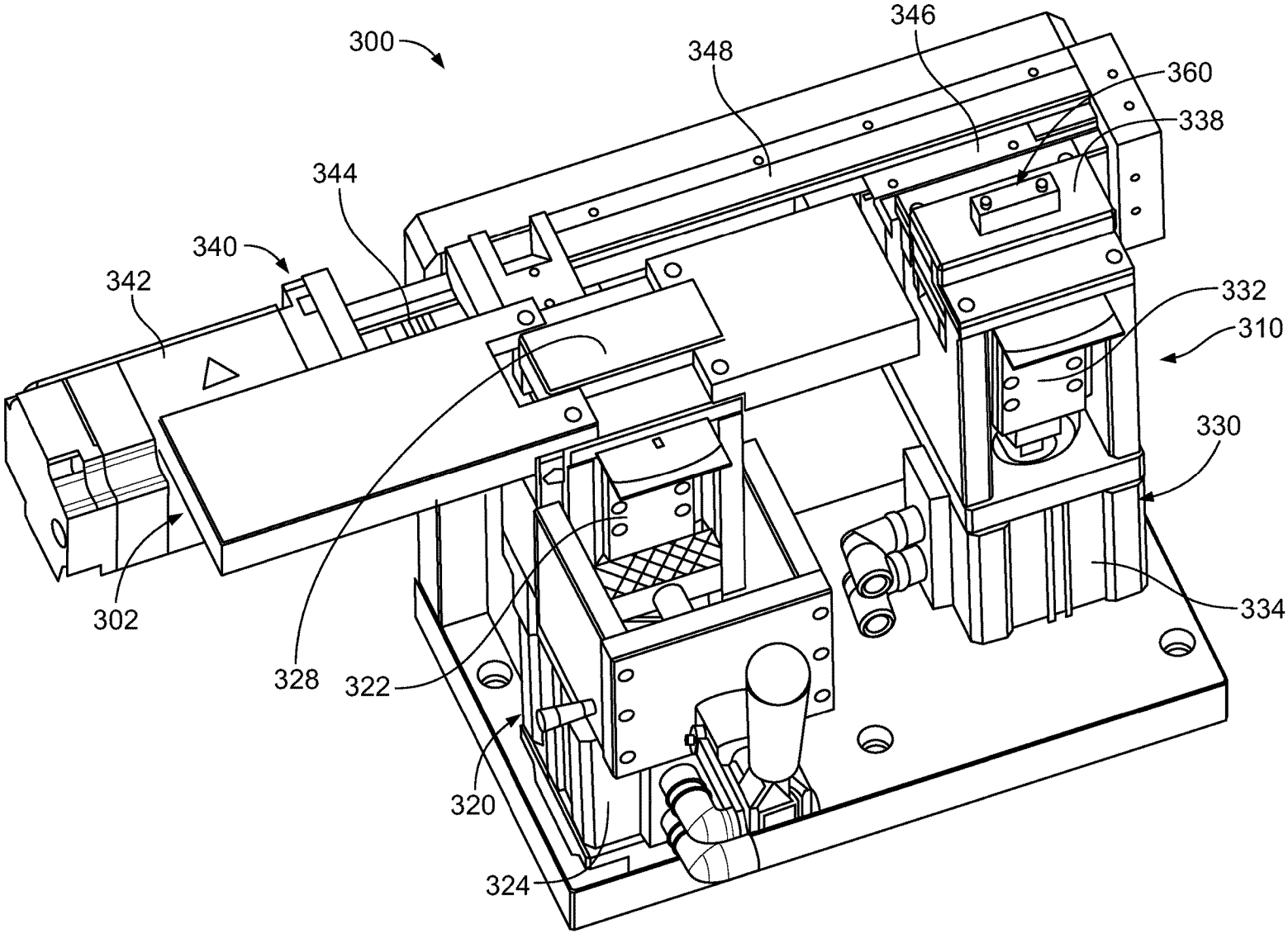
FIG. 14 is a perspective view of the connector strip feed unit in accordance with an exemplary embodiment showing the connector strip feed unit in a retracted position.
Figure 15:
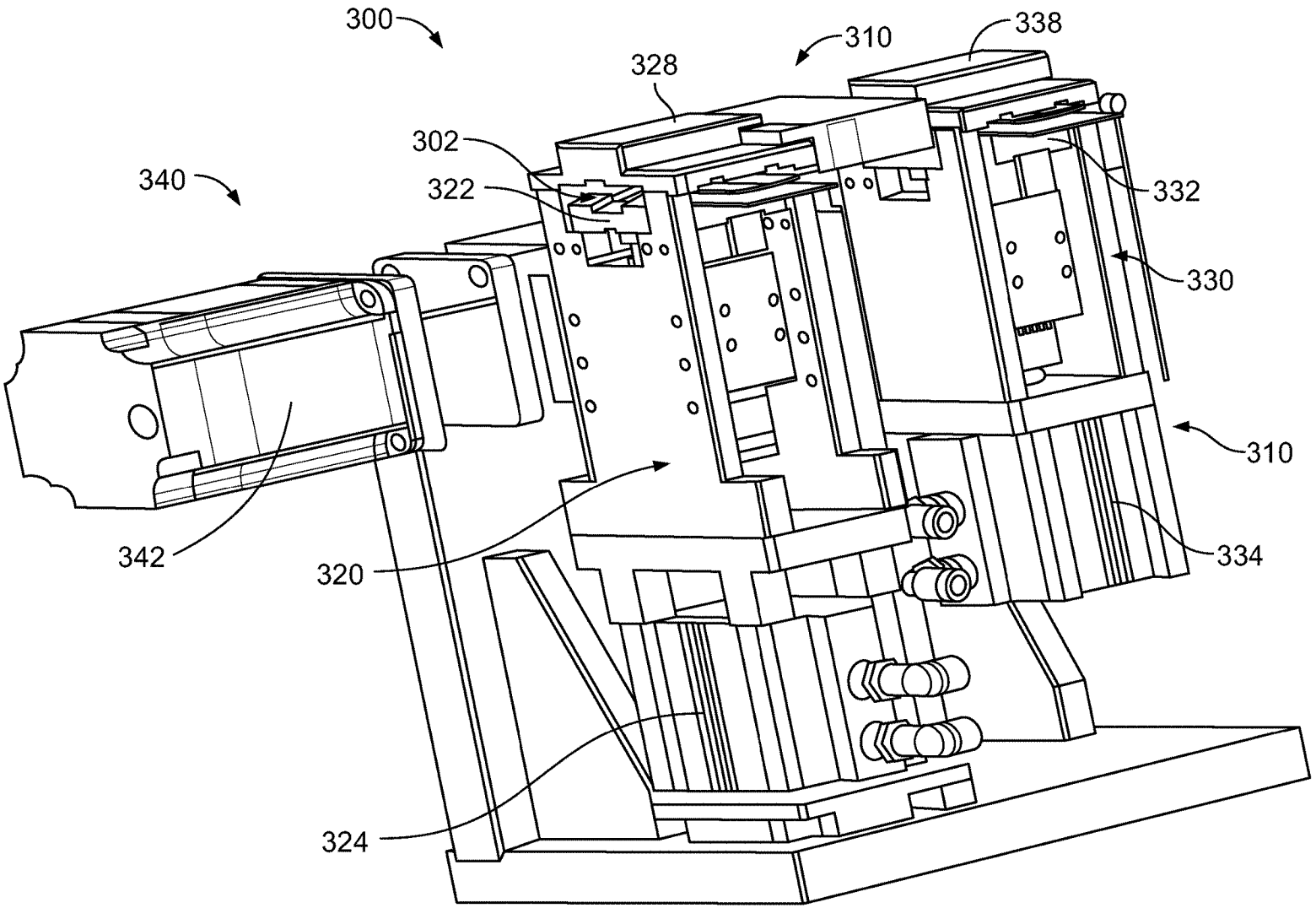
FIG. 15 is a perspective view of the connector strip feed unit in accordance with an exemplary embodiment showing the connector strip feed unit in an advanced position.

FIG. 14 is a perspective view of the connector strip feed unit 300 in accordance with an exemplary embodiment showing the connector strip feed unit 300 in a retracted position. FIG. 15 is a perspective view of the connector strip feed unit 300 in accordance with an exemplary embodiment showing the connector strip feed unit 300 in an advanced position. The connector strip feed unit 300 includes the feeding device 310 used to index the connector strip 110 through the feed track 302 in successive feed strokes. Each feed stroke advances the connector strip 110 a predetermined feed distance, such as a feed distance corresponding to four contact positions. The connector strip 110 is stationary for a portion of the feed stroke, such as while the feeding device 310 resets. The other manufacturing processes performed by the electrical connector assembling machine 100 are performed during each feed stroke, such as during the portion of the feed stroke when the connector strip 110 is stationary.

The feeding device 310 includes a holding device 320 and an indexing device 330. The indexing device 330 is movable relative to the holding device 320. The indexing device 330 is used to advance or feed the connecting strip 110 through the electrical connector assembling machine 100. The holding device 320 is in a fixed position relative to the frame of the electrical connector assembling machine 100. In an exemplary embodiment, the feeding device 310 includes an indexer 340 operably coupled to the indexing device 330. The indexer 340 moves the indexing device 330 relative to the fixed holding device 320 from a retracted position to an advanced position. The indexing device 330 moves the connector strip 110 as the indexing device 330 is moved from the retracted position to the advanced position. The indexing device 330 releases the connector strip 110 and moves relative to the connector strip 110 as the indexing device 330 is returned from the advanced position to the retracted position.

In an exemplary embodiment, the holding device 320 includes a holding clamp 322 and a holding actuator 324 operably coupled to the holding clamp 322. The holding actuator 324 is operated to move the holding clamp 322 between a clamping position (closed) and a released position (open). In the illustrated embodiment, the holding actuator 324 is a pneumatic actuator that allows opening and closing of the holding clamp 322. However, other types of actuators may be used in alternative embodiments, such as a hydraulic actuator, an electric actuator, and the like. The holding actuator 324 includes a piston configured to be extended and retracted to move the holding clamp 322. The holding clamp 322 is used to hold or fix the connector strip 110 relative to the holding device 320 in the clamping position. For example, the connector strip 110 may be captured between the holding clamp 322 and a clamping wall 328. The holding actuator 324 moves the holding clamp 322 toward and away from the clamping wall 328 during operation. The holding clamp 322 is released from the connector strip 110 in the released position and the connector strip 110 is allowed to move relative to the holding clamp 322 in the released position. In an exemplary embodiment, the holding clamp 322 and/or the clamping wall 328 includes slots or grooves that define the feed track 302.

In an exemplary embodiment, the indexing device 330 includes an indexing clamp 332 and an indexing actuator 334 operably coupled to the indexing clamp 332. The indexing actuator 334 is operated to move the indexing clamp 332 between a clamping position (closed) and a released position (open). In the illustrated embodiment, the indexing actuator 334 is a pneumatic actuator that allows opening and closing of the indexing clamp 332. However, other types of actuators may be used in alternative embodiments, such as a hydraulic actuator, an electric actuator, and the like. The indexing actuator 334 includes a piston configured to be extended and retracted to move the indexing clamp 332. The indexing clamp 332 is used to hold or fix the connector strip 110 relative to the indexing device 330 in the clamping position. For example, the connector strip 110 may be captured between the indexing clamp 332 and a clamping wall 338 to allow the connector strip 110 to move with the indexing device 330. The indexing actuator 334 moves the indexing clamp 332 toward and away from the clamping wall 338 during operation. The indexing clamp 332 is released from the connector strip 110 in the released position and the connector strip 110 is allowed to move relative to the indexing clamp 332 in the released position. In an exemplary embodiment, the indexing clamp 332 and/or the clamping wall 338 includes slots or grooves that define the feed track 302.

The indexer 340 moves the indexing device 330 in a feed direction along a feed stroke to advance or feed the connector strip 110 through the electrical connector assembling machine 100. The indexer 340 controls the feed distance that the connector strip 110 is indexed through the electrical connector assembling machine 100. Optionally, the indexer 340 feeds the connector strip 110 in a forward feed direction.

In the illustrated embodiment, the indexer 340 includes a motor 342, a ball screw 344 driven by the motor 342, and a carriage 346 operably coupled to the ball screw 344. The carriage 346 is slidable along a feed rail 348, which controls the feed direction. The indexing device 330 is mounted to the carriage 346, such as being bolted or otherwise fastened or secured to the carriage 346. The indexing device 330 is carried by the carriage 346 and is movable with the carriage 346 as the carriage 346 slides along the feed rail 348 both in the forward advancing direction and in the rearward retracting direction. For example, the carriage 346 moves the indexing device 330 relative to the holding device 320. The feed rail 348 may include one or more rods extending in a linear path between walls of the indexer 340. The motor 342 is operated to drive the ball screw 344 and move the carriage 346 in a forward direction and a reverse direction to move the indexing device 330 between the retracted position (FIG. 14) and the advanced position (FIG. 15). The indexer 340 has controlled movement and positioning for repeatable and known positioning of the indexing device 330, and thus the connector strip 110, within the electrical connector assembling machine 100. The indexer 340 may be programmable to control functions of the indexer 340, such as the feed stroke length, the feed stroke speed, and the like. Other types of drive mechanisms may be used in alternative embodiments.

In an exemplary embodiment, the connector strip feed unit 300 includes a marking device 360 operable to mark the connector strip 110 with an identification marking. In the illustrated embodiment, the marking device 360 is coupled to the indexing device 330. However, the marking device 360 may be coupled to the holding device 320 or another component along the feed track 302 in alternative embodiments. In an exemplary embodiment, the marking device 360 puts physical marks on the connector strip 110 during the clamping process (for example, when the indexing clamp 332 is closed or in the clamping position). The marks may be formed by pressing or indenting the plastic material of the connector strip 110. Other types of marks may be formed in alternative embodiments, such as cutting, notching, printing or otherwise marking the connector strip 110.

Figure 16:
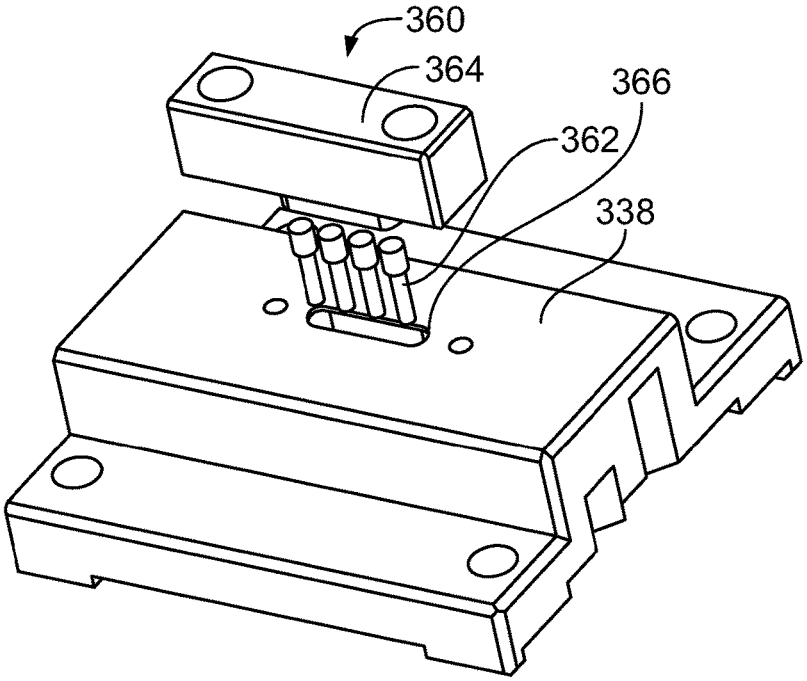
FIG. 16 is an exploded view of the marking device in accordance with an exemplary embodiment.

FIG. 16 is an exploded view of the marking device 360 in accordance with an exemplary embodiment. The marking device 360 includes markers 362 for marking an upper surface of the connector strip 110. A cap 364 is used to hold the markers 362 in the clamping wall 338. In the illustrated embodiment, the markers 362 may be posts, such as cylindrical posts. The markers 362 may have other shapes in alternative embodiments. Distal ends 366 of the markers 362 are configured to engage the connector strip 110. For example, the markers 362 may press into the connector strip 110 when the indexing device 330 is in the clamping position. The pressure from the clamping action presses the markers 362 into the material of the connector strip 110. Optionally, the connector strip 110 may be pressed into the markers 362. Alternatively, the markers 362 may be pressed into the connector strip 110. In the illustrated embodiment, four markers 362 are provided, each corresponding to a contact position of the connector strip. As such, the connector strip 110 is marked at each contact position. Greater or fewer markers 362 may be provided in alternative embodiments.

Figure 17:
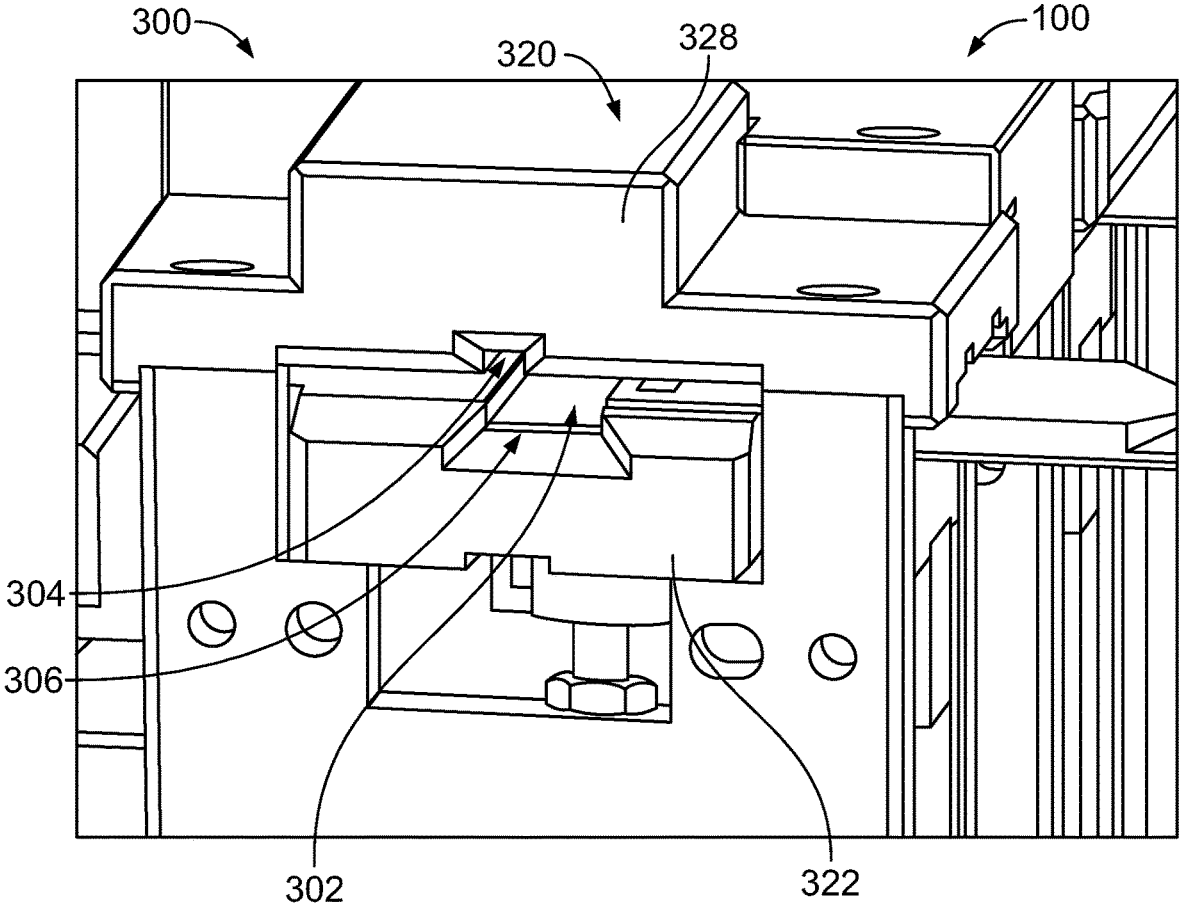
FIG. 17 is a rear perspective view of the connector strip feed unit in accordance with an exemplary embodiment showing the feed track.
Figure 18:
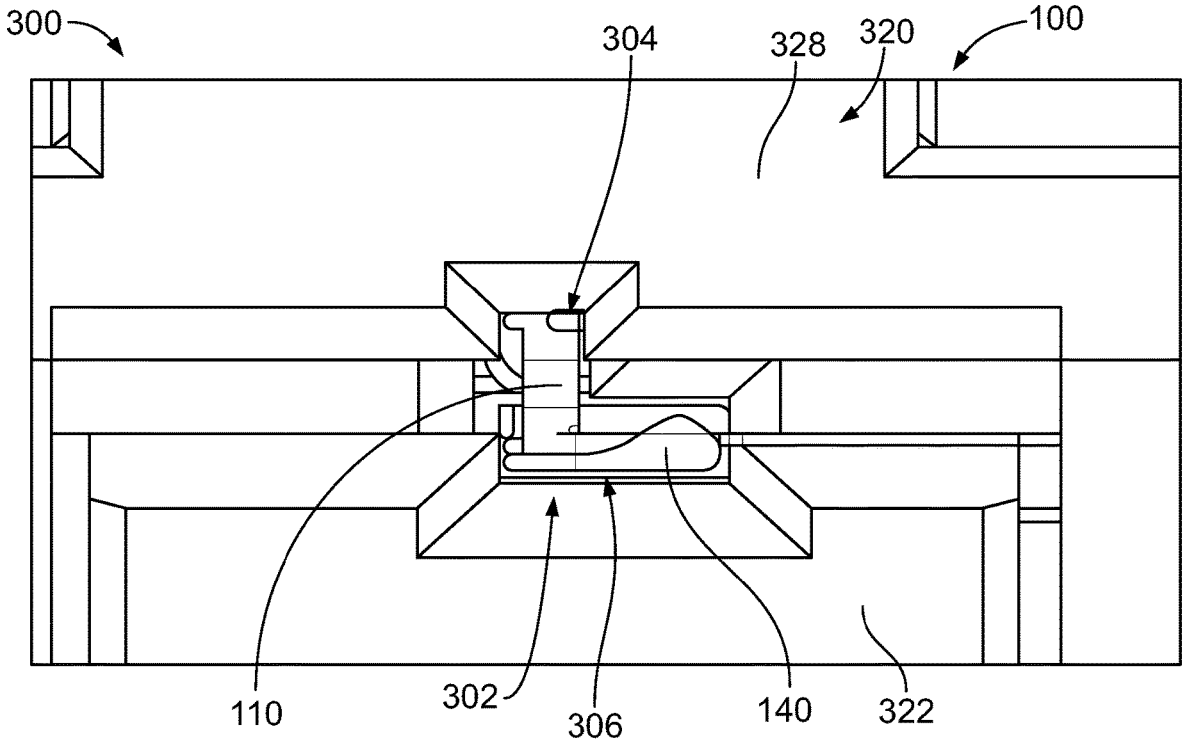
FIG. 18 is an end view of the connector strip feed unit in accordance with an exemplary embodiment showing the feed track.

FIG. 17 is a rear perspective view of the connector strip feed unit 300 in accordance with an exemplary embodiment showing the feed track 302. FIG. 18 is an end view of the connector strip feed unit 300 in accordance with an exemplary embodiment showing the feed track 302. The feed track 302 is shown in the holding device 320; however, the feed track 302 may be similar or identical through the indexing device 330.

The feed track 302 includes an upper feed track 304 and a lower feed track 306. The upper feed track 304 is provided in the clamping wall 328. The lower feed track 306 is provided in the holding clamp 322. The feed track 302 includes walls, surfaces or other features that guide and position the connector strip 110 through the connector strip feed unit 300. Optionally, the feed track 302 may include guides or lead-ins to guide loading of the connector strip 110 into the feed track 302. The feed track 302 is sized and shaped to receive the connector strip 110. In an exemplary embodiment, the feed track 302 is designed to receive different styles of connector strips 110, such as the connector strips illustrated in FIGS. 5, 9 and 10 without the need for switchout of the main components of the connector strip feed unit 300. Optionally, the connector strip feed unit 300 may include removable or replaceable plates that may be selectively coupled to the holding device 320 and/or the indexing device 330 to change the shape of the feed track 302 to accommodate the various connector strips 110. The feed track 302 may be slightly oversized to position the connector strip 110 as the connector strip 110 passes through the connector strip feed unit 300 while maintaining proper positioning of the connector strip 110, such as for engagement by the clamps 322, 332 and engagement by the marking device 360. In an exemplary embodiment, the lower feed track 306 is wider than the upper feed track 304 to receive the connector strip 110. For example, the lower feed track 304 may be sized to receive the finger 140 of the connector strip 110.

During use, the connector strip 110 is fed through the connector strip feed unit 300 in the feed track. The connector strip 110 is indexed through the connector strip feed unit 300 in successive advancing movements. For example, the connector strip 110 is advanced a feed distance by the indexing device 330 each time the connector strip feed unit 300 is operated. The connector strip feed unit 300 advances the connector strip 110 through the various stations of the electrical connector assembling machine 100, such as feeding the connector strip 110 to the connector strip notching unit 400 (shown in FIG. 1).

Figure 19:
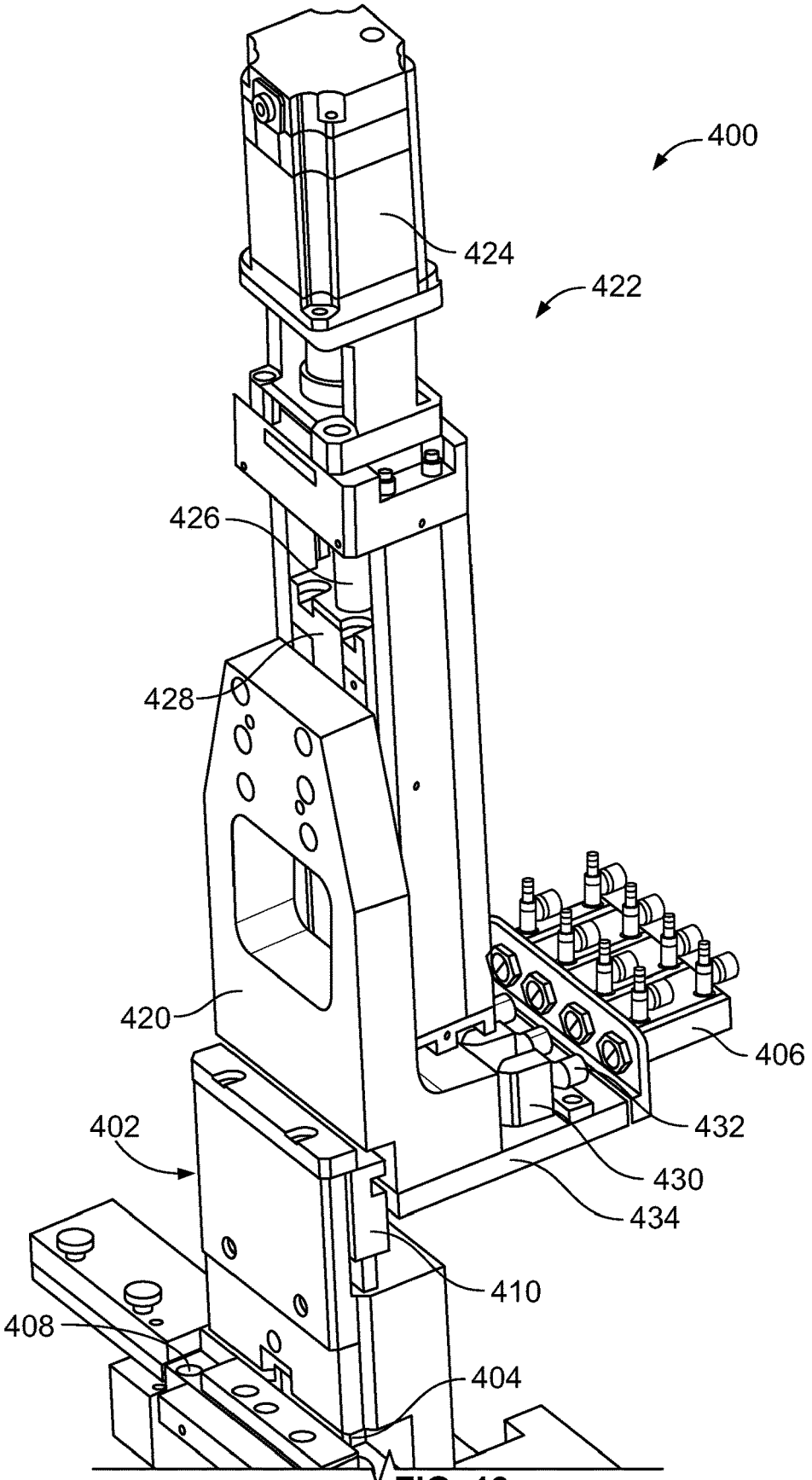
FIG. 19 is a front perspective view of the connector strip notching unit in accordance with an exemplary embodiment.
Figure 20:
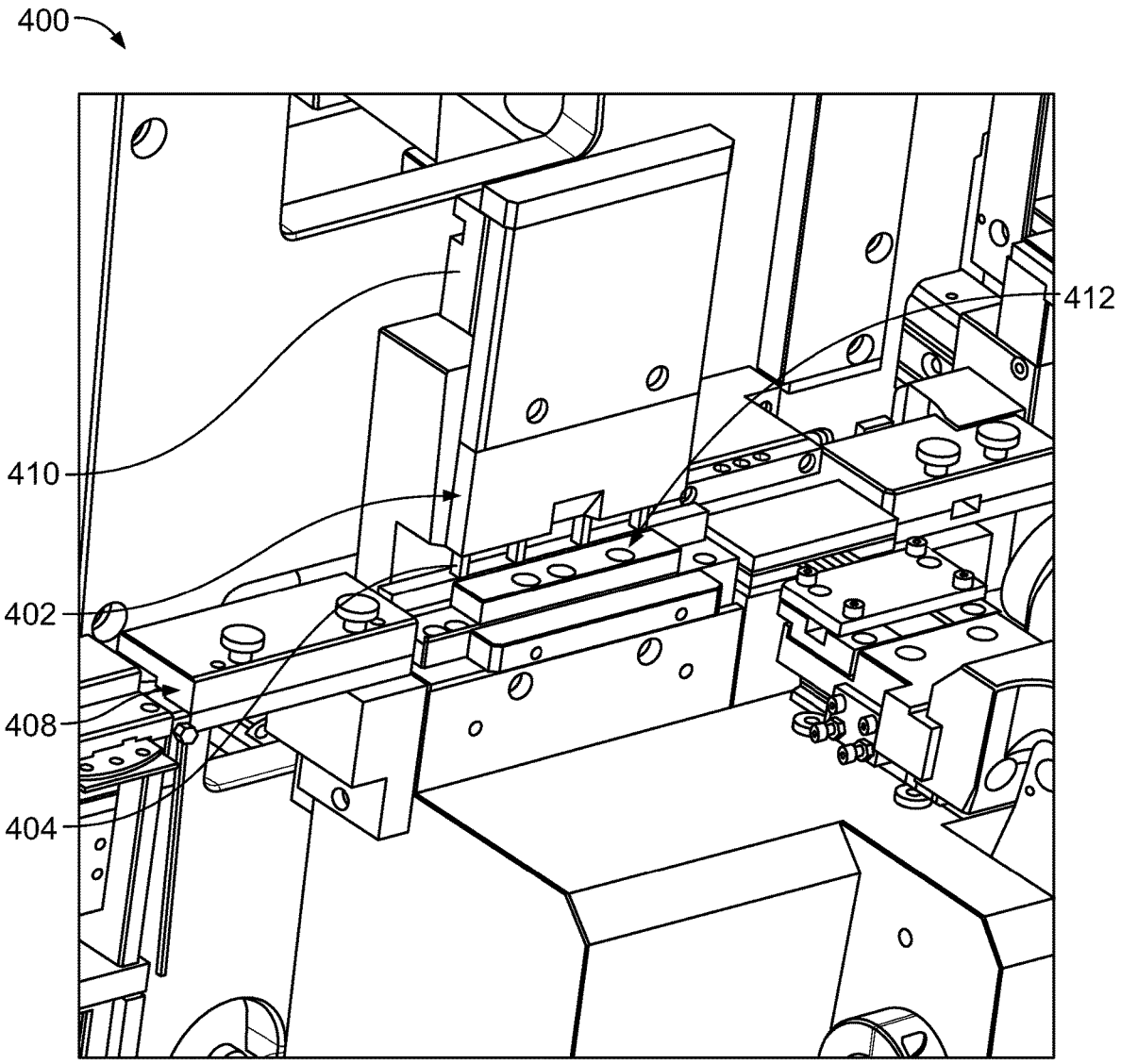
FIG. 20 is a rear perspective view of a portion of the connector strip notching unit in accordance with an exemplary embodiment.

FIG. 19 is a front perspective view of the connector strip notching unit 400 in accordance with an exemplary embodiment. FIG. 20 is a rear perspective view of a portion of the connector strip notching unit 400 in accordance with an exemplary embodiment. The connector strip notching unit 400 includes the notching device 402 with the cutters 404 for selectively cutting through the dielectric material of the connector strip 110. The notching unit controller 406 selectively actuates the cutters 404 as the connector strip 110 is indexed through the connector strip notching unit 400.

The connector strip 110 is fed to the connector strip notching unit 400 by the connector strip feeding unit 300. The connector strip notching unit 400 may include a track 408 to guide and position the connector strip 110 for notching. The cutters 404 are located above a notching zone of the track 408. Once the connector strip 110 is positioned (for example, stationary) in the notching zone directly below the cutters 404, the notching device 402 is operated to advance corresponding cutters 404 to notch the plastic material of the connector strip 110 at select locations. Any number of the cutters 404 may be actuated depending on the desired notching scheme. The notching scheme depends on the length of electrical connectors being manufactured (for example, two position connectors versus four position connectors versus fifteen position connectors versus twenty-four position connectors, and the like) and depending on the length of the feed stroke (for example, a four position feed stroke). Any combination of the cutters 404 may be employed to notch the connector strip 110 at desired locations, such as locations corresponding to ends of the electrical connectors. In the illustrated embodiment, the connector strip notching unit 400 includes four cutters 404. The cutters 404 are spaced apart at a predetermined pitch, which may be equal to a contact pitch between contacts that corresponds to a contact pitch of the electrical connectors.

The connector strip notching unit 400 includes a cutter holder 410 used to hold the cutters 404. The cutter holder 410 includes channels 412 holding the individual cutters 404. The cutters 404 are movable in the channels 412. For example, the cutters 404 may be able to slide vertically within the channels 412 during the notching operation.

The connector strip notching unit 400 includes a ram 420 and a ram driver 422 operably coupled to the ram 420. The ram 420 is movable in a vertical driving direction by the ram driver 422. The ram 420 is used to press the cutters 404 downward during the notching operation. In the illustrated embodiment, the ram driver 422 includes an electric motor 424, a ball screw 426 driven by the motor 424, and a carriage 428 operably coupled to the ball screw 426. The carriage 428 is movable in a vertical direction. The ram 420 is coupled to the carriage 428 and movable in the vertical direction with the carriage 428. The ram 420 may be mounted to the carriage 428 using bolts or other types of fasteners. The ram 420 is movable with the carriage 428 in both an upward, retracting direction and a downward, driving direction. The motor 424 is operated to drive the ball screw 426 and move the carriage 428 and ram 420. The motor is programmable to control the driving stroke of the ram 420. The ram 420 thus has controlled movement and positioning for repeatable and known positioning of the cutters 404. Other types of drive mechanisms may be used in alternative embodiments.

The connector strip notching unit 400 includes keys 430 and cutter actuators 432 operably coupled to the keys 430. The keys 430 and cutter actuators 432 are held on a support plate 434, which is coupled to and movable with the ram 420. The keys 430 extend into the ram 420 and are configured to interface with the cutters 404. The keys 430 are movable by the cutter actuators 432 based on the notching scheme. For example, the keys 430 may be movable between engaged and disengaged positions. The keys 430 engage the cutters 404 in the engaged positions. The keys 430 are disengaged from the cutters 404 in the disengaged positions. The keys 430 are used to drive the cutters 404 when in the engaged positions. The keys 430 do not drive the cutters 404 (and thus the cutters 404 are not actuated) when in the disengaged positions. The cutter actuators 432 are operably coupled to the notching unit controller 406. Operation of the cutter actuators 432 are controlled by the notching unit controller 406. In the illustrated embodiment, the cutter actuators 432 are pneumatic actuators that move the keys 430 between the engaged and disengaged positions. However, other types of actuators may be used in alternative embodiments, such as hydraulic actuators, electric actuators, and the like.

Figure 21:
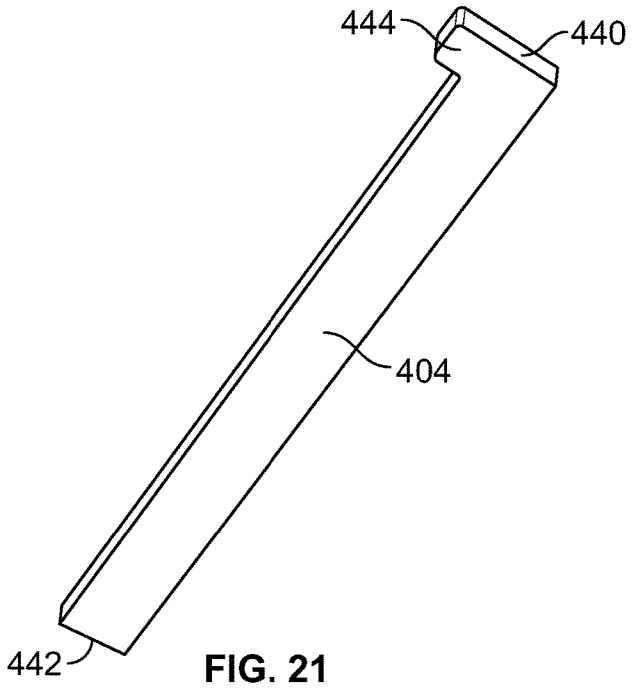
FIG. 21 is a perspective view of the cutter in accordance with an exemplary embodiment.

FIG. 21 is a perspective view of the cutter 404 in accordance with an exemplary embodiment. The cutter 404 may be used to punch or cut through the plastic material of the connector strip 110 to remove some of the material and form the notches 142, 144 (shown in FIG. 5). The cutter 404 may be manufactured from a metal material, such as steel. The cutter 404 includes an actuation end 440 and a cutting end 442. The cutting end 442 is driven into the plastic material of the connector strip 110 to remove the material and form the notches 142, 144. The actuation end 440 is configured to be engaged by the corresponding key 430 (shown in FIG. 19) during the notching operation. In the illustrated embodiment, the actuation end 440 includes a locating finger 444. The locating finger 444 is used for positioning the cutter 404 within the notching device 402. For example, the locating finger 444 provides surfaces for driving the cuter 404 downward and for lifting the cutter 404 upward during the notching stroke.

Figure 22:
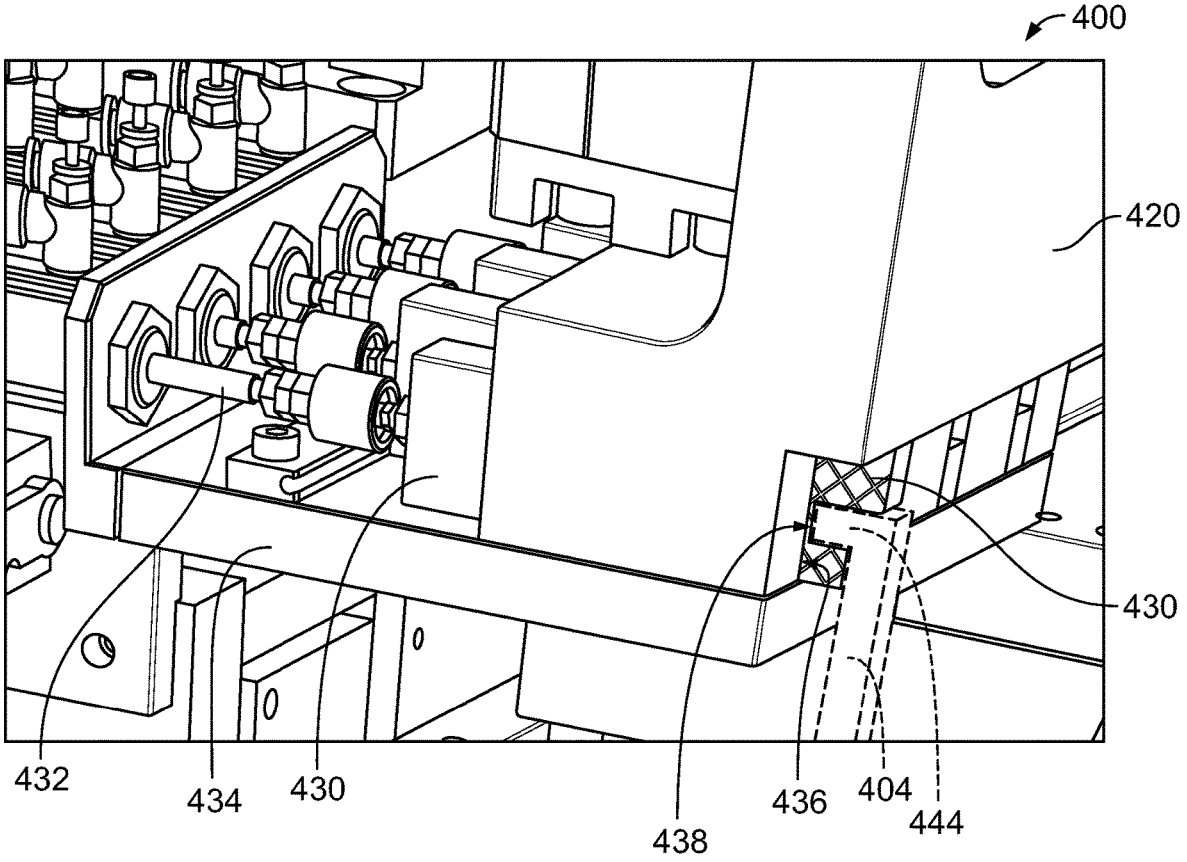
FIG. 22 is a rear perspective view of a portion of the connector strip notching unit in accordance with an exemplary embodiment.

FIG. 22 is a rear perspective view of a portion of the connector strip notching unit 400 in accordance with an exemplary embodiment. The keys 430 are received in channels 436 in the ram 420. The keys 430 are slidable relative to the ram 420 and the support plate 434. The keys 430 are selectively movable. For example, none, some or all of the keys 430 may be actuated at a particular time, according to the notching scheme. In an exemplary embodiment, each key 430 includes a keyway 438 that is sized and shaped to receive the locating finger 444 (shown in FIG. 21) of the corresponding cutter 404. The keyway 438 is formed by surfaces located above and below the keyway 438. The surfaces of the key 430 forming the keyway 438 are used to engage and move the cutter 404 during operation. For example, the driving surface above the keyway 438 presses downward on the cutter 404 to drive the cutter downward while the lifting surface below the keyway 438 is used to lift the cutter 404 upward.

In operation, the cutter actuators 432 are used to move the keys 430 between the engaged and disengaged positions (one key 430 is shown in the engaged position while the other keys 430 are shown in disengaged positions). The cutter actuators 432 advance the ends of the keys 430 out of the ram 420 to interface with the cutter 404 in the engaged position. When the ram 420 is driven downward, the extended keys 430, in the engaged positions, engage the corresponding cutters 404 and drive the cutters 404 to form the notches 142, 144 in the material of the connector strip 110. The keys 430 that are in the disengaged positions are positioned interior of the ram 420 and will not engage the corresponding cutters 430 when the ram 420 is actuated. As such, the notching is controlled by the cutter actuators 432 such that none, some or all of the cutters 404 may be utilized depending on which of the cutter actuators 432 and keys 430 are operated.

Returning to FIG. 1, after the connector strip 110 advances through the connector strip notching unit 400, the unloaded connector strip 110 (connector strip without contacts loaded therein) is fed to the contact loading unit 500. The contacts 106 are loaded into the connector strip 110 at the contact loading unit 500. In an exemplary embodiment, the contact loading device 502 is used to simultaneously load multiple contacts 106 into the connector strip 110, such as when the connector strip 110 is stationary for a period of time. In various embodiments, four contacts 106 may be loaded into corresponding positions in the connector strip 110 during each feed stroke.

After the contacts 106 are loaded into the connector strip 110, the loaded connector strip 110 (connector strip with contacts 106 loaded therein) is fed to the electrical connector separating unit 600. The cutter 602 separates the electrical connectors 102 from the connector strip 110. Different length electrical connectors 102 may be manufactured by the electrical connector assembling machine 100 by varying the length of the connector strip 110 fed through the electrical connector separating unit 600 before operating the cutter 602. The electrical connectors 102 may be transported or loaded to another machine or container for further processing and/or assembly to a circuit board and/or shipping.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector assembling machine for assembling an electrical connector including a connector housing manufactured from a connector strip that is a continuous extruded dielectric material and contacts manufactured from continuous contact strips, the electrical connector assembling machine comprising:

a connector strip distribution unit including a reel cradle for holding a reel of the connector strip, the connector strip distribution unit including a roller for rotating the reel of the connector strip to unwind the connector strip from the reel, the connector strip distribution unit including a roller actuator operably coupled to the roller to rotate the roller;

a connector strip feed unit including a feed track receiving the connector strip, the connector strip feed unit including a feeding device configured to index the connector strip through the feed track in successive feed strokes, the feeding device including a holding device having a holding clamp and an indexing device having an indexing clamp, the holding clamp being in a fixed position, the feeding device including an indexer operably coupled to the indexing device, the indexer moving the indexing device relative to the holding device from a retracted position to an advanced position, the indexing device moving the connector strip as the indexing device is moved from the retracted position to the advanced position, the indexing device moving relative to the connector strip as the indexing device is returned from the advanced position to the retracted position;

a connector strip notching unit including a notching device configured to cut notches in the connector strip at designated locations defining ends of connector housings formed from the connector strip, the notching device including a plurality of cutters for selectively cutting through the dielectric material of the connector strip, the connector strip notching unit including a notching unit controller operably coupled to the plurality of cutters to selectively operate the cutters as the connector strip is indexed through the feed track in the successive feed strokes;

a contact loading unit including a contact loading device loading contacts into the connector strip as the connector strip is advanced through the electrical connector assembling machine; and an electrical connector separating unit including a cutting device for separating the electrical connector from the connector strip.

2. The electrical connector assembling machine of claim 1, wherein the indexing clamp is in a clamping position as the indexing device is moved from the retracted position to the advanced position and is in a released position as the indexing device is moved from the advanced position to the retracted position, and wherein the holding clamp is in a released position as the indexing device is moved from the retracted position to the advanced position and is in a clamping position as the indexing device is moved from the advanced position to the retracted position.

3. The electrical connector assembling machine of claim 1, wherein the indexing device includes an indexing actuator operably coupled to the indexing clamp, the indexing actuator operated to move the indexing clamp between a clamping position and a released position, and wherein the holding device includes a holding actuator operably coupled to the holding clamp, the holding actuator operated to move the holding clamp between a clamping position and a released position.

4. The electrical connector assembling machine of claim 1, wherein the indexer includes a motor, a ball screw driven by the motor, and a carriage operably coupled to the ball screw, the carriage being slidable along a feed rail, the indexing device being carried by the carriage and movable with the carriage as the carriage slides along the feed rail, wherein the motor is operated to drive the ball screw and move the carriage in a forward direction and a reverse direction to move the indexing device between the retracted position and the advanced position.

5. The electrical connector assembling machine of claim 1, wherein the connector strip feed unit includes a marking device operable to mark the connector strip with an identification marking.

6. The electrical connector assembling machine of claim 1, wherein the notching device includes a plurality of cutter actuators operably coupled to the corresponding cutters, the notching unit controller being operably coupled to the cutter actuators to selective cause actuation of the cutters in accordance with a notching scheme.

7. The electrical connector assembling machine of claim 1, wherein the cutters are spaced apart at a pitch equal to a contact pitch between the contacts.

8. The electrical connector assembling machine of claim 1, wherein the reel cradle includes a platform at a bottom of the reel cradle, the roller being provided in the platform to support a bottom of the reel when the reel is loaded into the reel cradle.

9. The electrical connector assembling machine of claim 1, wherein the connector strip distribution unit includes a roller trigger operably coupled to the roller actuator, the connector strip engaging the roller trigger to activate the roller trigger to cause the roller actuator to activate to rotate the roller.

10. An electrical connector assembling machine for assembling an electrical connector including a connector housing manufactured from a connector strip that is a continuous extruded dielectric material and contacts manufactured from continuous contact strips, the electrical connector assembling machine comprising:

a connector strip distribution unit including a reel cradle for holding a reel of the connector strip;

a connector strip feed unit including a feed track receiving the connector strip, the connector strip feed unit including a feeding device configured to index the connector strip through the feed track in successive feed strokes, the feeding device including a holding device having a holding clamp and an indexing device having an indexing clamp, the holding clamp being in a fixed position, the feeding device including an indexer operably coupled to the indexing device, the indexer moving the indexing device relative to the holding device from a retracted position to an advanced position, the indexing device moving the connector strip as the indexing device is moved from the retracted position to the advanced position, the indexing device moving relative to the connector strip as the indexing device is returned from the advanced position to the retracted position;

a connector strip notching unit including a notching device configured to cut notches in the connector strip at designated locations defining ends of connector housings formed from the connector strip;

a contact loading unit including a contact loading device loading contacts into the connector strip as the connector strip is advanced through the electrical connector assembling machine; and an electrical connector separating unit including a cutting device for separating the electrical connector from the connector strip.

11. The electrical connector assembling machine of claim 10, wherein the indexing clamp is in a clamping position as the indexing device is moved from the retracted position to the advanced position and is in a released position as the indexing device is moved from the advanced position to the retracted position, and wherein the holding clamp is in a released position as the indexing device is moved from the retracted position to the advanced position and is in a clamping position as the indexing device is moved from the advanced position to the retracted position.

12. The electrical connector assembling machine of claim 10, wherein the indexer moves the indexing clamp along a feed stroke, the feed stroke being a same feed distance irrespective of a length of the connector housing being manufactured.

13. The electrical connector assembling machine of claim 10, wherein the indexing device includes an indexing actuator operably coupled to the indexing clamp, the indexing actuator operated to move the indexing clamp between a clamping position and a released position, and wherein the holding device includes a holding actuator operably coupled to the holding clamp, the holding actuator operated to move the holding clamp between a clamping position and a released position.

14. The electrical connector assembling machine of claim 10, wherein the indexer includes a carriage slidable along a feed rail, the indexing device being carried by the carriage and movable with the carriage as the carriage slides along the feed rail.

15. The electrical connector assembling machine of claim 10, wherein the indexer includes a motor, a ball screw driven by the motor, and a carriage operably coupled to the ball screw, the indexing device being coupled to and movable with the carriage, the motor being operated to drive the ball screw and move the carriage in a forward direction and a reverse direction to move the indexing device between the retracted position and the advanced position.

16. The electrical connector assembling machine of claim 10, wherein the connector strip feed unit includes a marking device operable to mark the connector strip with an identification marking.

17. An electrical connector assembling machine for assembling an electrical connector including a connector housing manufactured from a connector strip that is a continuous extruded dielectric material and contacts manufactured from continuous contact strips, the electrical connector assembling machine comprising:

a connector strip distribution unit including a reel cradle for holding a reel of the connector strip;

a connector strip feed unit including a feed track receiving the connector strip, the connector strip feed unit including a feeding device configured to index the connector strip through the feed track in successive feed strokes;

a connector strip notching unit including a notching device configured to cut notches in the connector strip at designated locations defining ends of connector housings formed from the connector strip, the notching device including a plurality of cutters for selectively cutting through the dielectric material of the connector strip, the connector strip notching unit including a notching unit controller operably coupled to the plurality of cutters to selectively operate the cutters as the connector strip is indexed through the feed track in the successive feed strokes;

a contact loading unit including a contact loading device loading contacts into the connector strip as the connector strip is advanced through the electrical connector assembling machine; and an electrical connector separating unit including a cutting device for separating the electrical connector from the connector strip.

18. The electrical connector assembling machine of claim 17, wherein the notching device includes a plurality of cutter actuators operably coupled to the corresponding cutters, the notching unit controller being operably coupled to the cutter actuators to selective cause actuation of the cutters in accordance with a notching scheme.

19. The electrical connector assembling machine of claim 17, wherein any number of the plurality of cutters may be actuated during a particular feed stroke to form zero notches, a single notch or multiple notches depending on a notching scheme for the particular feed stroke.

20. The electrical connector assembling machine of claim 19, wherein a different number of the cutters are actuated during successive feed strokes.

21. The electrical connector assembling machine of claim 17, wherein the plurality of cutters includes a first cutter, a second cutter, a third cutter and a fourth cutter, at least two of the cutters being actuated to notch the connector strip when manufacturing electrical connectors having less than four contacts.

22. The electrical connector assembling machine of claim 17, wherein the cutters are spaced apart at a pitch equal to a contact pitch between the contacts.

23. An electrical connector assembling machine for assembling an electrical connector including a connector housing manufactured from a connector strip that is a continuous extruded dielectric material and contacts manufactured from continuous contact strips, the electrical connector assembling machine comprising:

a connector strip distribution unit including a reel cradle for holding a reel of the connector strip, the connector strip distribution unit including a roller for rotating the reel of the connector strip to unwind the connector strip from the reel, the connector strip distribution unit including a roller actuator operably coupled to the roller to rotate the roller;

a connector strip feed unit including a feed track receiving the connector strip, the connector strip feed unit including a feeding device configured to index the connector strip through the feed track in successive feed strokes;

a connector strip notching unit including a notching device configured to cut notches in the connector strip at designated locations defining ends of connector housings formed from the connector strip;

a contact loading unit including a contact loading device loading contacts into the connector strip as the connector strip is advanced through the electrical connector assembling machine; and an electrical connector separating unit including a cutting device for separating the electrical connector from the connector strip.

24. The electrical connector assembling machine of claim 23, wherein the reel cradle includes a platform at a bottom of the reel cradle, the roller being provided in the platform.

25. The electrical connector assembling machine of claim 23, wherein the roller supports a bottom of the reel.

26. The electrical connector assembling machine of claim 23, wherein the connector strip distribution unit includes a roller trigger operably coupled to the roller actuator, the roller trigger causing the roller actuator to activate to rotate the roller.

27. The electrical connector assembling machine of claim 26, wherein the connector strip engages the roller trigger to activate the roller trigger.

28. The electrical connector assembling machine of claim 23, wherein the reel cradle includes a ramp leading to the roller, the reel configured to be rolled on the ramp to the roller.

* * * * *